US008682201B2

(12) United States Patent
Kobayashi

(10) Patent No.: US 8,682,201 B2
(45) Date of Patent: Mar. 25, 2014

(54) IMAGE FORMING APPARATUS HAVING FIRST AND SECOND GROUND CONDUCTING ROUTES

(75) Inventor: Takashi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/449,775

(22) Filed: Apr. 18, 2012

(65) Prior Publication Data

US 2012/0207526 A1 Aug. 16, 2012

Related U.S. Application Data

(60) Division of application No. 13/072,323, filed on Mar. 25, 2011, now Pat. No. 8,195,063, which is a continuation of application No. 11/870,013, filed on Oct. 10, 2007, now Pat. No. 7,929,879, which is a continuation of application No. 11/014,576, filed on Dec. 16, 2004, now abandoned.

(30) Foreign Application Priority Data

Dec. 19, 2003 (JP) ..... 2003-423074

(51) Int. Cl.
*G03G 15/00* (2006.01)

(52) U.S. Cl.
USPC ..... 399/90; 399/390; 361/212; 361/214

(58) Field of Classification Search
USPC ..... 399/90, 384, 390; 361/212, 214
See application file for complete search history.

(56) References Cited

U.S. PATENT DOCUMENTS

| | | | |
|---|---|---|---|
| 3,757,164 | A | 9/1973 | Binkowski |
| 3,877,805 | A | 4/1975 | Heldenbrand et al. |
| 4,385,824 | A | 5/1983 | Hollo |
| 4,760,492 | A | 7/1988 | Walsh |
| 6,899,411 | B2 | 5/2005 | Niikura et al. |
| 7,044,595 | B2 | 5/2006 | Youn |
| 7,764,898 | B2 | 7/2010 | Kobayashi |
| 7,929,879 | B2 | 4/2011 | Kobayashi |

(Continued)

FOREIGN PATENT DOCUMENTS

| | | | | |
|---|---|---|---|---|
| JP | 60093045 A | * | 5/1985 | ..... B65H 1/04 |
| JP | 4159943 A | | 6/1992 | |

(Continued)

OTHER PUBLICATIONS

Official Translation of Image Forming Apparatus [Gazou keisei souchi] by Hiroshi Abe, Nov. 2012.*

*Primary Examiner* — David Gray
*Assistant Examiner* — Laura Roth
(74) *Attorney, Agent, or Firm* — Panitch Schwarze Belisario & Nadel LLP

(57) ABSTRACT

An image forming apparatus including an image forming apparatus body, a cassette attaching section having a media supplying roller, a media cassette with a loading plate and a supporting section, a first ground conducting route and a second ground conducting route. The first ground conducting route conducts static electricity charged on the media when the media stacked in the media cassette is spaced away from the media supplying roller. A conducting portion of the first ground conducting route maintains the media cassette in an electrically disconnected state when the media passes through an opening in the cassette attaching section and reconfigures the media cassette from the electrically disconnected state to an electrically connected state before the media cassette reaches a first position. The second ground conducting route conducts static electricity charged on the media when the media cassette is in the first position.

8 Claims, 25 Drawing Sheets

(56) References Cited

U.S. PATENT DOCUMENTS

| | | | |
|---|---|---|---|
| 2005/0135833 | A1 | 6/2005 | Kobayashi |
| 2011/0170922 | A1 | 7/2011 | Kobayashi |

FOREIGN PATENT DOCUMENTS

| | | | | | |
|---|---|---|---|---|---|
| JP | 05-058479 | A | | 3/1993 | |
| JP | 6115723 | A | | 4/1994 | |
| JP | 7215511 | A | | 8/1995 | |
| JP | 07215511 | A | * | 8/1995 | ..... B65H 3/46 |
| JP | 7237783 | A | | 9/1995 | |
| JP | 10067441 | A | | 3/1998 | |
| JP | 11222329 | A | * | 8/1999 | ..... B65H 3/46 |
| JP | 2001253567 | A | * | 9/2001 | ..... B65H 1/26 |
| JP | 2002226070 | A | | 8/2002 | |
| JP | 2003192161 | A | | 7/2003 | |

* cited by examiner

IMAGE FORMING APPARATUS HAVING FIRST AND SECOND GROUND CONDUCTING ROUTES

CROSS-REFERENCE TO RELATED APPLICATIONS

This application is a division of published U.S. patent application Ser. No. 13/072,323 filed Mar. 25, 2011, which is a continuation of U.S. Pat. No. 7,929,879 filed Oct. 10, 2007, which is a continuation U.S. patent application Ser. No. 11/014,576 filed Dec. 16, 2004, now abandoned, the disclosures of which are incorporated herein by reference.

BACKGROUND OF THE INVENTION

1. Field of the Invention

The present invention relates to an image forming apparatus to prevent trouble caused by static electricity.

2. Description of Related Art

In some kinds of image forming apparatuses such as what uses an electrophotographic method, an electrostatic method, or a magnetoelectric method; toner images are formed on surfaces of photosensitive drums etc. based on image information received from host devices. These toner images are transcribed onto recording media supplied from media supplying units. And, these toner images are fixed with heat in fixing units, so as to form images. In the media supplying units, media contained in media cassettes are pressed to media supplying rollers, so as to be supplied. Inside of the media cassettes, loading plates to be pushed to the media supplying rollers are provided. And, the recording media are loaded on these loading plates. In these states, the loading plates with media are pushed or moved toward the media supplying rollers. Then, the recording media are pressed to the media supplying rollers. And, each medium is separated and supplied one by one by a conveying force of media supplying rollers with friction between the rolls and separating rubbers.

In the media supplying apparatus, static electricity is generated by friction such as friction between the recording medium and the media supplying roller, friction between the recording medium and the separating rubber, or friction between the recording media themselves, when the recording media are conveyed. Moreover, in some cases, static electricity is already charged on the recording medium, before the media supplying unit is attached to the image forming apparatus. Such static electricity can flow in unexpected routes. Especially, in an image forming apparatus of recent years, many component parts are made of resin. Therefore, much static electricity is likely to be generated on the recording medium loaded on a media cassette made of resin. The static electricity flowing in unexpected routes becomes a noise of electric current that causes inconvenience such as drop of graphical quality, malfunction of the apparatus, or electric shocks to operators (c.f. JP 7-237783).

Therefore, the present invention is made to remove inconvenience such as drop of graphical quality, malfunction of the apparatus, or electric shocks to operators caused by static electricity flowing in unexpected routes becoming a noise of electric current.

BRIEF SUMMARY OF THE INVENTION

According to one aspect of the present invention, there is provided an image forming apparatus having: a first ground conducting route for conducting static electricity charged on a recording medium through an outer frame of a media supplying unit to a grounding point, and a second ground conducting route for conducting static electricity charged on a recording medium through a media supplying roller to a grounding point.

And in the image forming apparatus mentioned above: the first ground conducting route is formed when the media supplying unit is on a way to a position where the media supplying unit is attached to the image forming apparatus body, so as to conduct static electricity charged before the media supplying unit is attached to the image forming apparatus body; and the second ground conducting route conducts static electricity charged after the media supplying unit is attached to the image forming apparatus body.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Embodiment 1

Configuration

Figure 1:
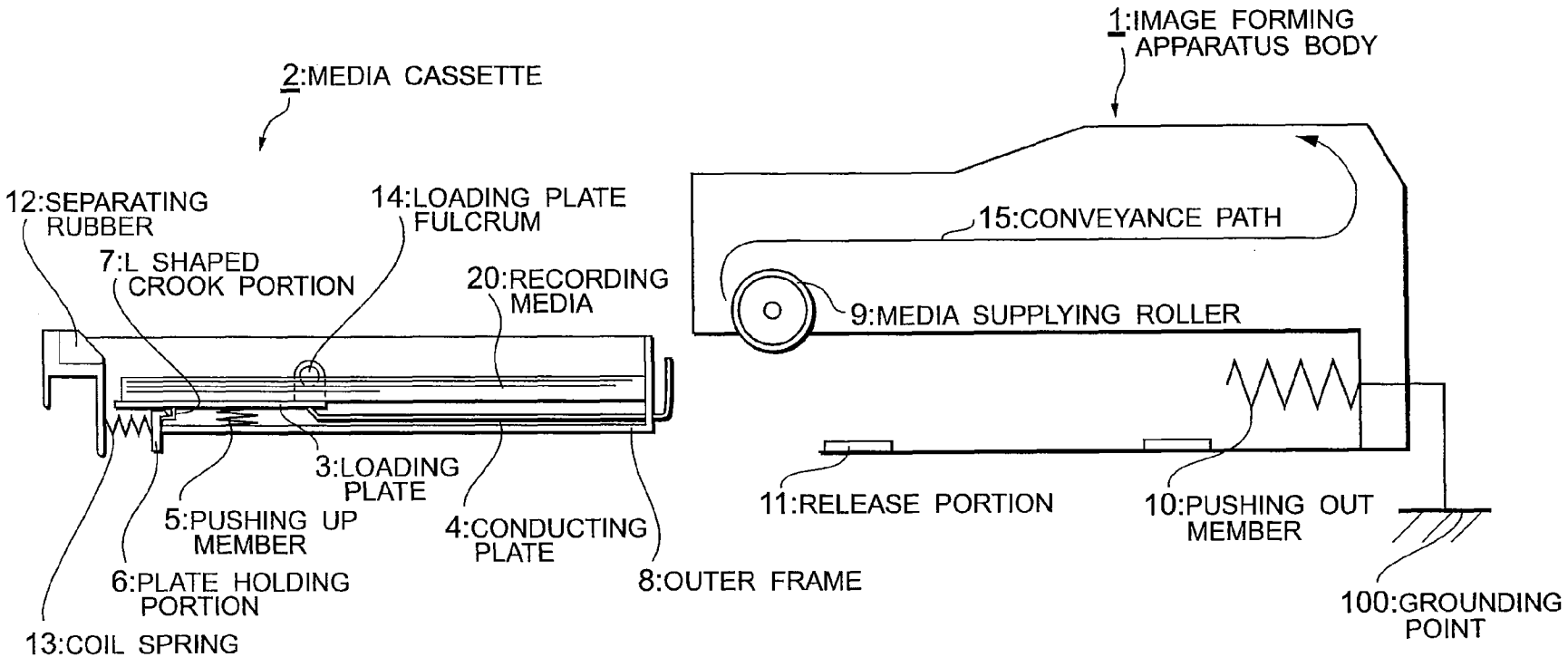
FIG. 1 is an explanatory diagram showing a chief elements of a structure (before attaching) of Embodiment 1.

FIG. 1 is an explanatory diagram showing a chief elements of a structure (before attaching) of Embodiment 1.

FIG. 1 shows a diagram of an image showing a positional relation of chief component parts only, seeing inside of an apparatus through a side wall of the apparatus' body, so as to refer to explain a structure, a function and an operation of Embodiment 1.

As shown in FIG. 1, chief component parts of Embodiment 1 are an image forming apparatus body 1 and a media cassette 2. The image forming apparatus body 1 comprises a media supplying roller 9, a pushing out member 10, a release portion 11 and a conveyance path 15. The media cassette 2 (media supplying unit) comprises a loading plate 3, a conducting plate 4, a pushing up member 5, a plate holding portion 6, an L shaped crook portion 7, an outer frame 8, a separating rubber 12, a coil spring 13 and a loading plate fulcrum 14.

Before explaining a structure, a function and an operation of Embodiment 1 referring to FIG. 1, overall structure and operation of an image forming apparatus to which the present invention is applied (Embodiment 1 to 4) are explained.

Figure 2:
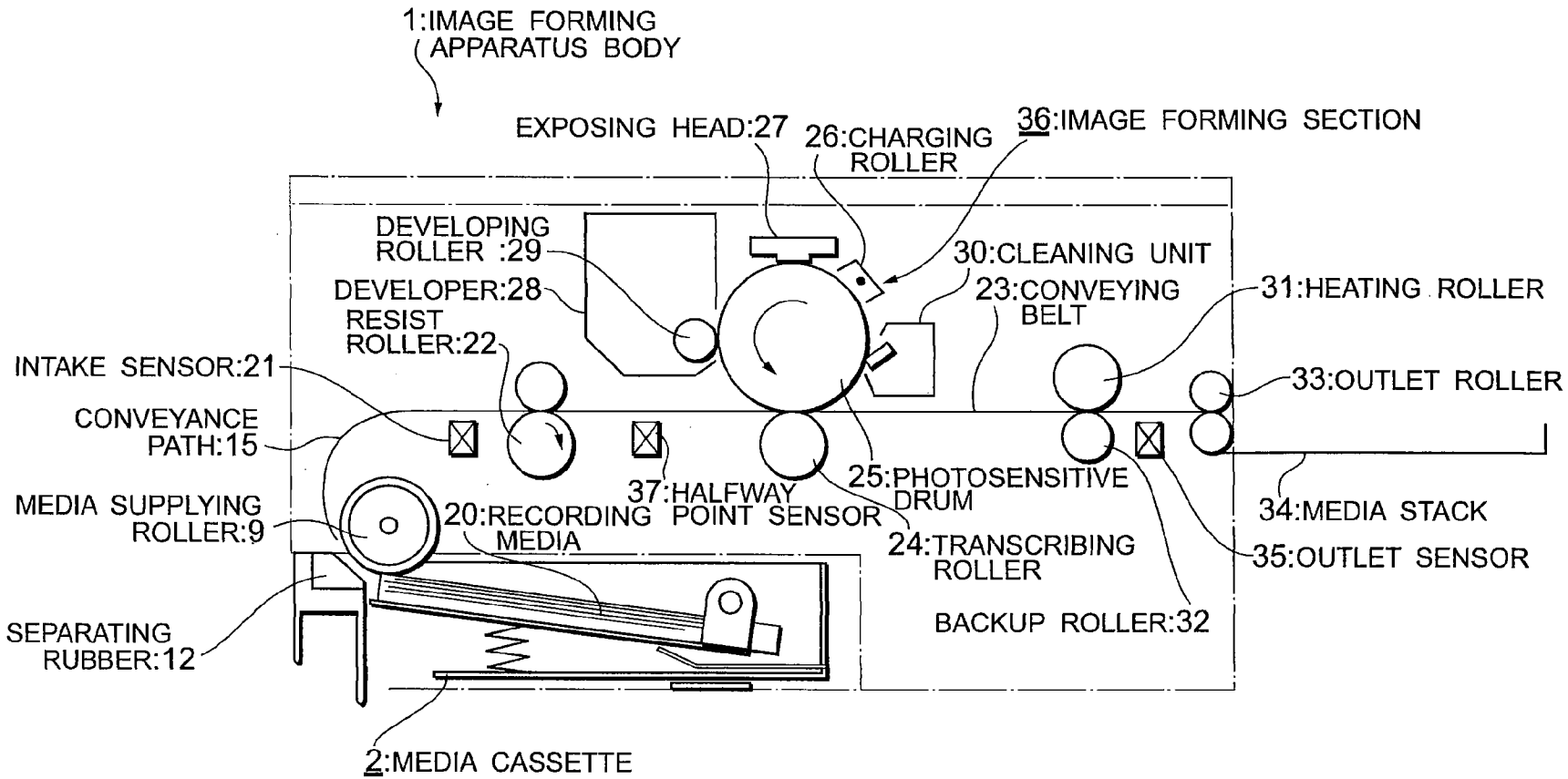
FIG. 2 is an explanatory diagram showing an image forming apparatus.

FIG. 2 is an explanatory diagram showing an image forming apparatus.

FIG. 2 shows a diagram of an image showing chief component parts only, seeing an inside of the apparatus through a side wall of the apparatus' body, so as to refer to explain an overall structure and operation of the image forming apparatus to which the present invention is applied.

As shown in FIG. 2, a pile of recording media 20 are contained in a media cassette 2. Each of recording media 20 are supplied by a combination of a media supplying roller 9 and a separating rubber 12 one by one from the media cassette 2 to a conveyance path 15. Then, a static electricity is generated by frictions such as a friction between each of recording media 20 and a media supplying roller 9, a friction between each of recording media 20 and a separating rubber 12, and a friction between recording media 20 themselves. And, how to discharge this static electricity is a subject of the present invention.

Each of recording media 20 supplied to a conveyance path 15 separated one by one, are sensed by an intake sensor 21. After that, each of recording media 20 are sent by a resist roller 22 to a conveying belt 23 which is a portion of the conveyance path 15. When each of recording media 20 pass at a halfway point sensor 37, an image forming section 36 starts forming a toner image. This toner image is transcribed by a transcribing roller 24 to each of recording media 20 conveyed on a conveying belt 23.

Formation of a toner image inside of the image forming section 36, is performed as follows. A surface of a photosensitive drum 25 rotating in a direction shown by an arrow, is charged negative by a charging roller 26. When this negative charged portion comes to a position under an exposing head 27, the exposing head 27 radiates light, so as to form electrostatic latent image at the charged portion based on an image data. This electrostatic latent image is developed by a developing roller 29 provided in a developer 28, so as to be a toner image. This toner image is transcribed by a transcribing roller 24 to one of recording media 20. Then, toner remained on the surface of the photosensitive drum 25 is removed by a cleaning unit 30.

The toner image transcribed by the transcribing roller 24 to one of recording media 20, is fixed with a treatment of high temperature and high pressure by a heating roller 31 and a backup roller 32. The one of recording media 20 on which a toner image is fixed, is let out by an outlet roller 33 onto a medium stack 34, an outlet of the one of recording media 20, is detected by an outlet sensor 35.

As mentioned above, an outline of the overall structure and operation of an image forming apparatus, has been explained. And, the chief component parts shown in FIG. 1 referred to above, will be explained in detail, referring to a slant view corresponding to Embodiment 1.

Figure 3:
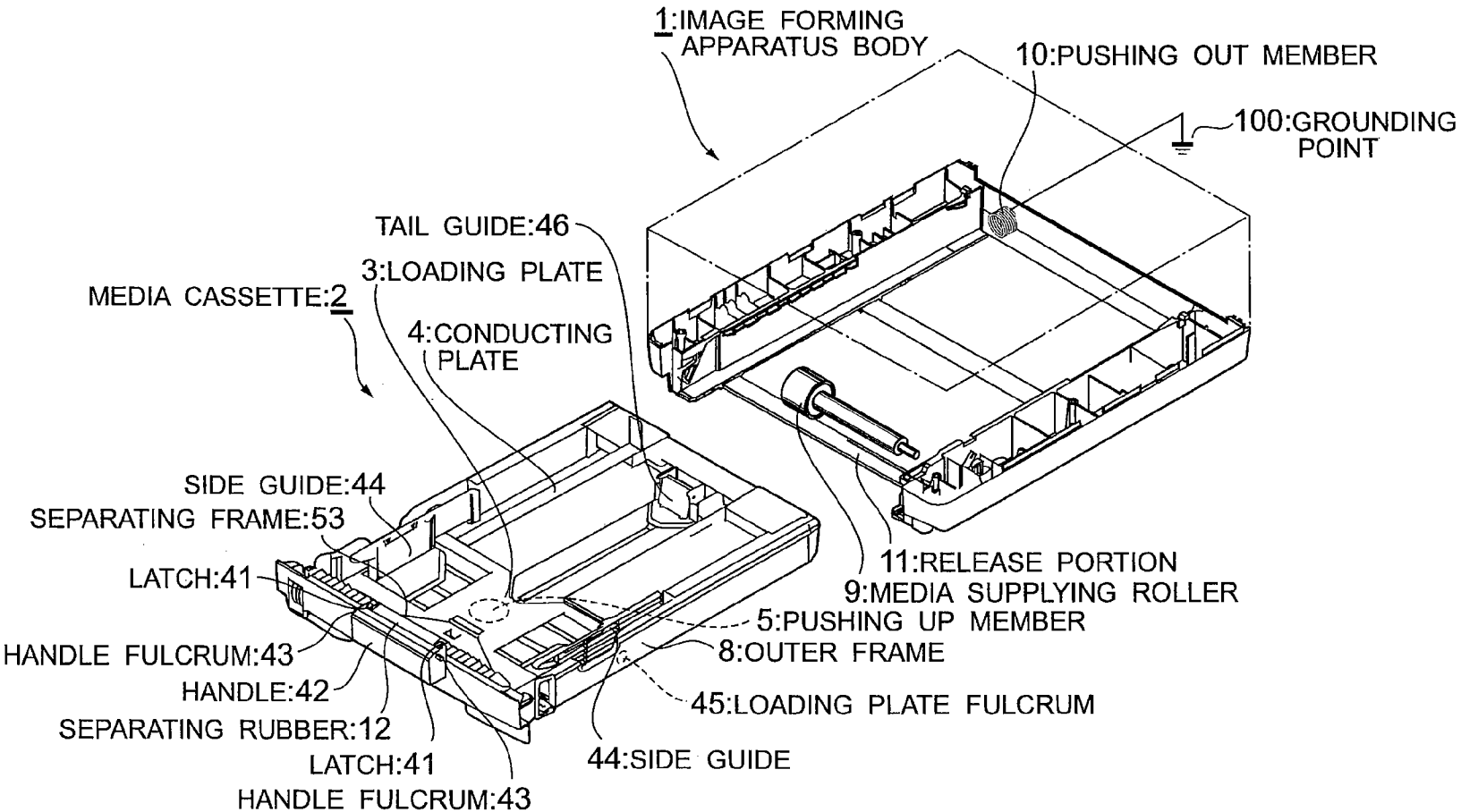
FIG. 3 is a slant viewed diagram showing a media cassette and its attaching portion of Embodiment 1.

FIG. 3 is a slant viewed diagram showing a media cassette and its attaching portion of Embodiment 1.

FIG. 3 shows a slant view of a media cassette and a slant view of a portion of an image forming apparatus body where the media cassette is attached.

When a user is going to detach the media cassette 2 from the image forming apparatus body 1, he touches his hand to a handle 42. Then, the handle 42 rotates around a handle fulcrum 43 which is supporting the handle 42. And, a latch 41 is taken off. Then, the media cassette 2 is pushed out by a pushing out member 10 provided in the image forming apparatus body 1.

A loading plate 3 is provided in the media cassette 2. And, a pile of recording media (not shown in FIG. 3) are loaded on the loading plate 3. Then, a pair of side guides 44 hold the recording media 20 (shown in FIG. 1) at longitudinal sides of them, and a tail guide 46 holds a lateral side of them, so as not to scatter in the media cassette 2.

Thus, the recording media (not shown in FIG. 3) held in the media cassette 2 and loaded on the loading plate 3, are pressed by a pushing up member 5 to the media supplying roller 9 provided in the image forming apparatus body 1, after the media cassette 2 is attached to the image forming apparatus body 1. The loading plate 3 is supported by a loading plate fulcrum 45, so as to rotate up and down around the loading plate fulcrum 45.

Figure 4:
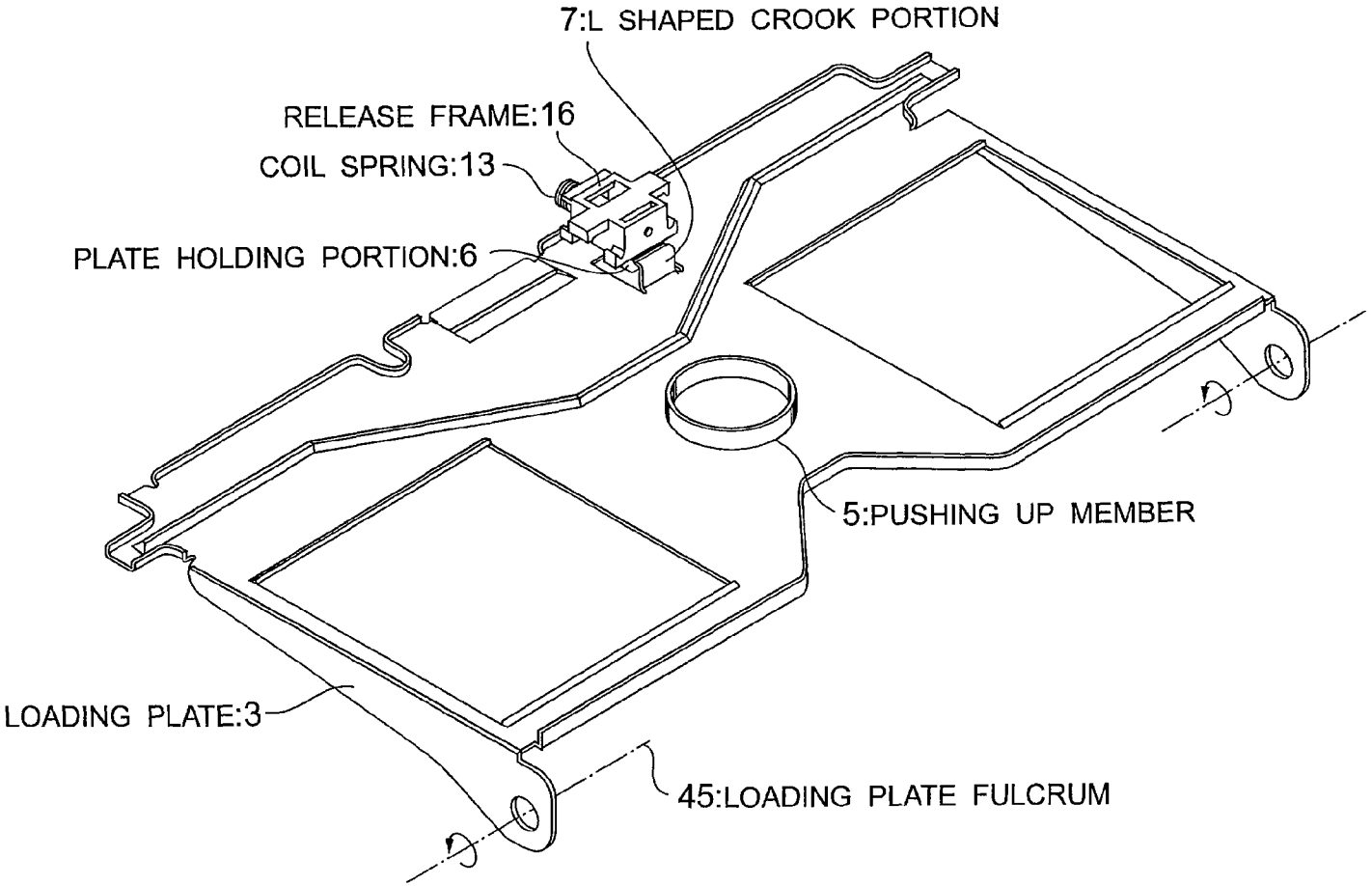
FIG. 4 is a slant viewed diagram showing a loading plate of Embodiment 1.

FIG. 4 is a slant viewed diagram showing a loading plate of Embodiment 1.

FIG. 4 shows a slanted view of a backside of the loading plate 3 which is taken apart from the image forming apparatus body 1.

As shown in FIG. 4, a loading plate 3 with a pile of recording media 20 is pressed to a media supplying roller 9 by a pushing up member 5 comprising a coil spring.

Moreover, a release frame 16 is made for containing a force of a pushing up member 5 by engaging a plate holding portion 6 with an L shaped crook portion 7 formed on the backside of the loading plate 3, when the media cassette 2 is not attached to the image forming apparatus body 1. Here, the release frame 16 with the plate holding portion 6 is provided at a prescribed portion of an outer frame (shown in FIG. 3). When the media cassette 2 is attached to the image forming apparatus body 1, a release portion 11 formed on an inner base of the image forming apparatus body 1 (shown in FIG. 1) releases the engagement between the plate holding portion 6 and the L shaped crook portion 7, with pressing a coil spring 13.

Returning to FIG. 1, a function and an operation of Embodiment 1 will be described.

As shown in FIG. 1, the recording media 20 are loaded on the loading plate 3 piling up on it. The recording media 20 are held by a pair of side guides 44 (FIG. 3) at longitudinal sides. And, they are held by a tail guide 46 at a lateral side. Thus, they do not scatter in the media cassette 2. In FIG. 1, a force of a pushing up member 5 is contained by engaging a plate holding portion 6 with an L shaped crook portion 7 formed on the backside of the loading plate 3, as the media cassette 2 is not attached to the image forming apparatus body 1.

A conducting plate 4 is provided, so that one end portion of it contacts with at least either of said recording medium 20 or said loading plate 3 and that other end of it is projected to outside of the media cassette 2.

Figure 5:
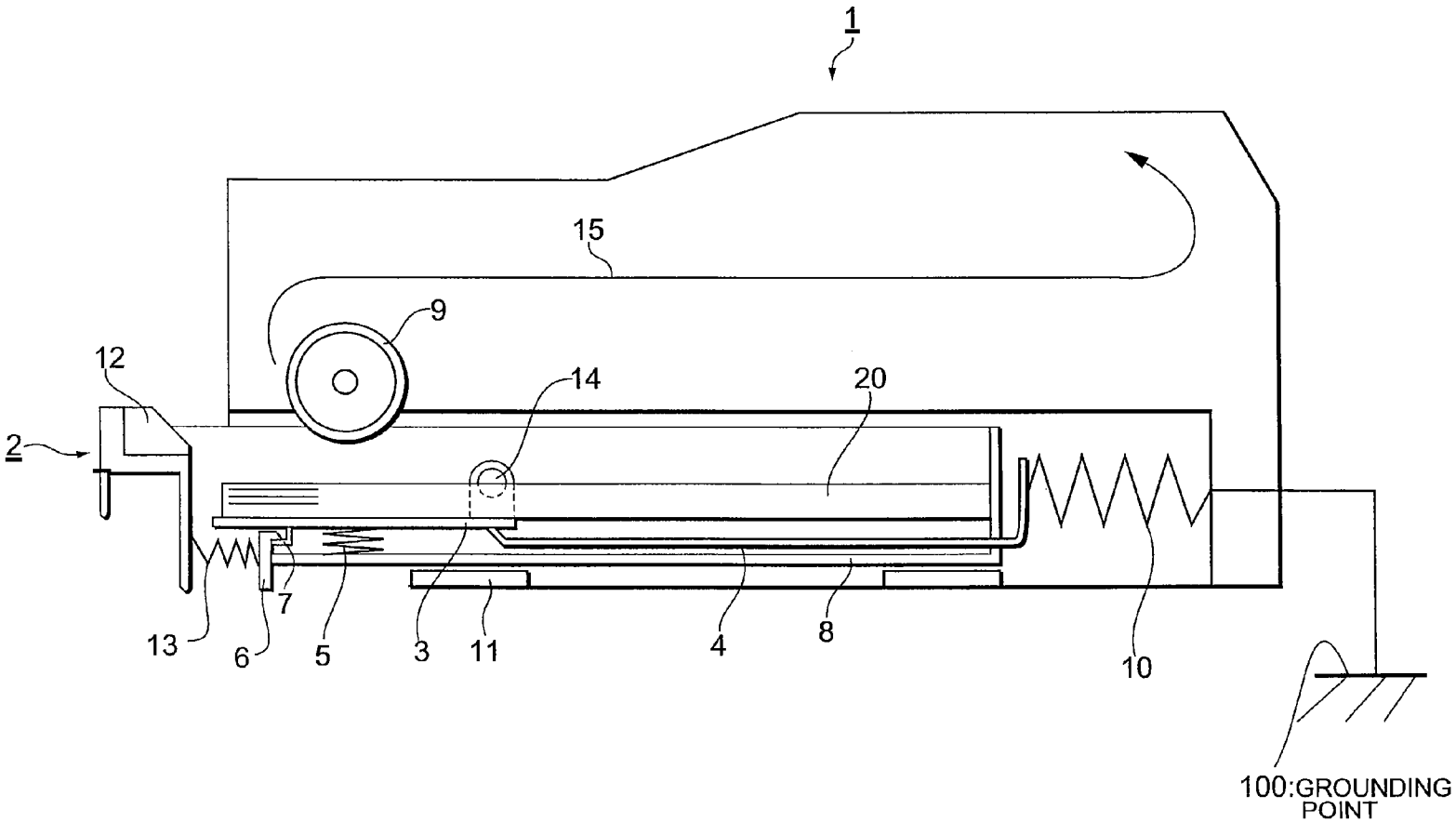
FIG. 5 is an explanatory diagram showing a chief elements of a structure (a first state of combination) of Embodiment 1.

FIG. 5 is an explanatory diagram showing a chief elements of a structure (a first state of combination) of Embodiment 1.

FIG. 5 shows a state that a conducting plate 4 of the media cassette 2 contacts with a pushing out member 10 of the image forming apparatus body 1, when the media cassette 2 is on a way to a position where the media cassette 2 is attached to the image forming apparatus body 1 (a first state of combination).

In the first state of combination, a first ground conducting route comprising the recording media 20, the loading plate 3, the conducting member 4 and the pushing out member 10; is formed. A static electricity already charged before the attachment, on a recording medium or in the media cassette including the loading plate 3, is discharged through the first ground conducting route to a grounding point 100.

Figure 6:
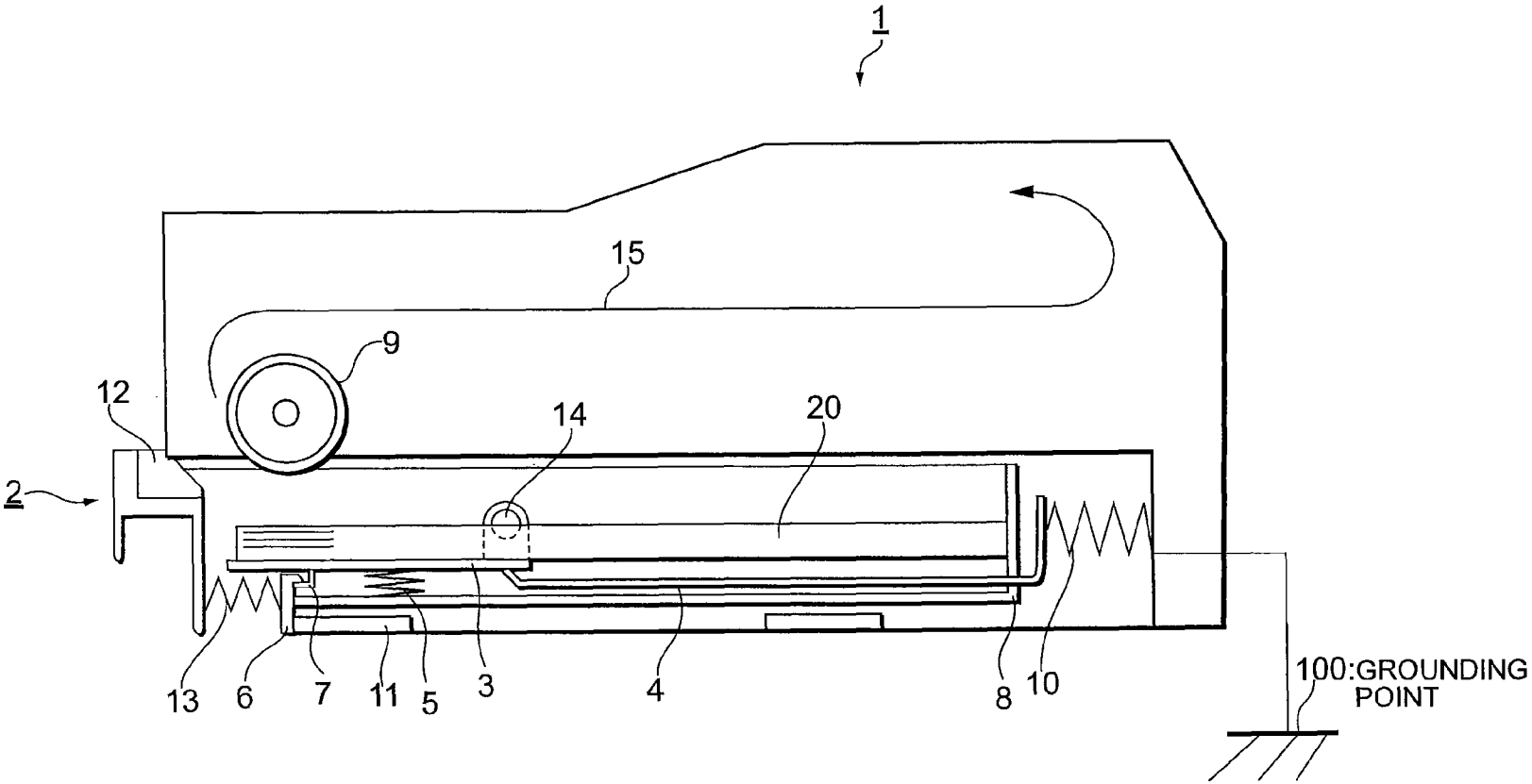
FIG. 6 is an explanatory diagram showing a chief elements of a structure (a second state of combination) of Embodiment 1.

FIG. 6 is an explanatory diagram showing a chief elements of a structure (a second state of combination) of Embodiment 1.

FIG. 6 shows a state that a plate holding portion 6 of the media cassette 2 contacts with a release portion 11 of the image forming apparatus body 1, when the media cassette 2 is still on a way near to a position where the media cassette 2 is attached to the image forming apparatus body 1 (a second state of combination).

In the second state of combination, the recording media 20 does not contact with a media supplying roller 9 yet, because a force of a pushing up member 5 is contained by engaging a plate holding portion 6 with an L shaped crook portion 7 formed on the backside of the loading plate 3.

Figure 7:
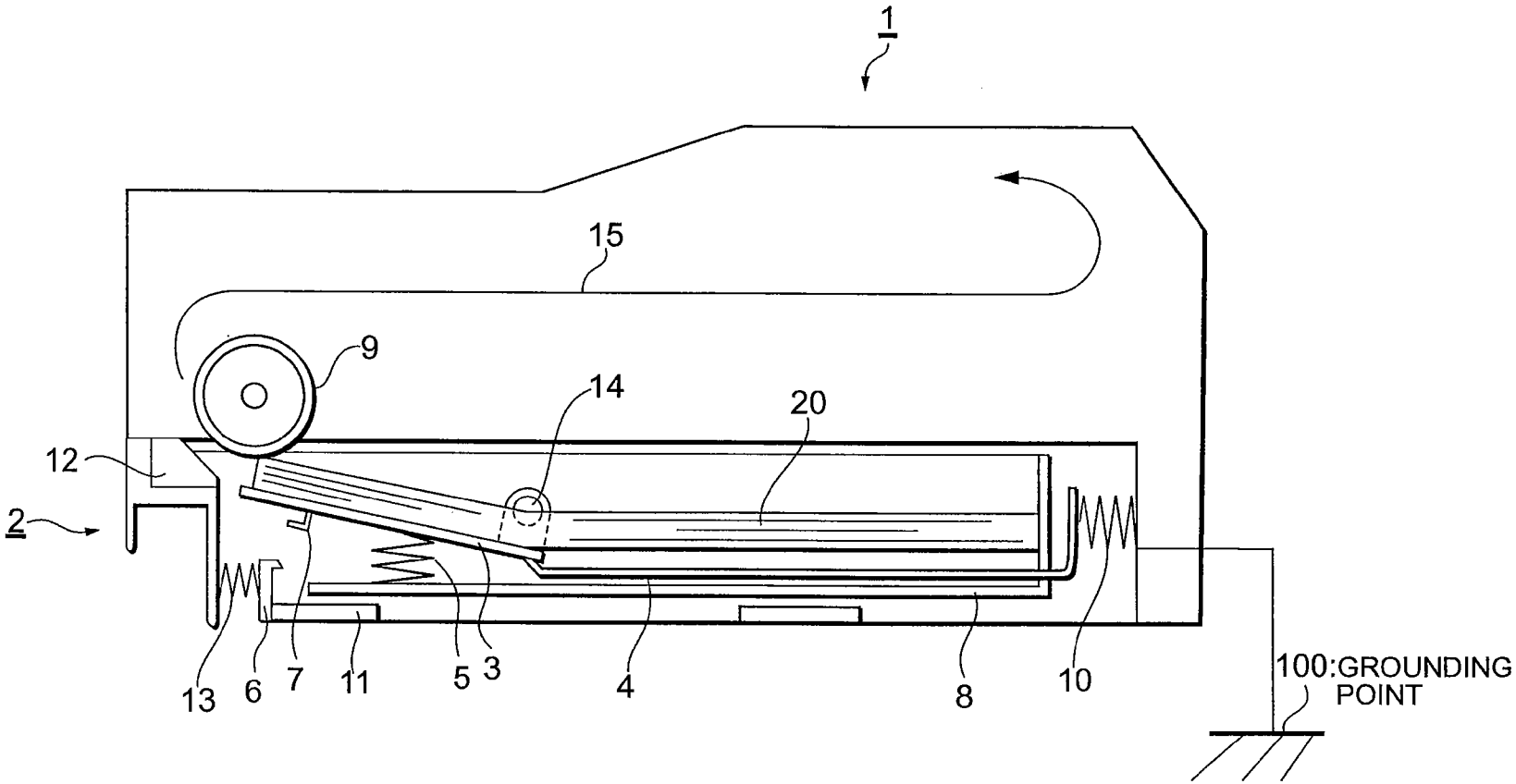
FIG. 7 is an explanatory diagram showing a chief elements of a structure (a state of completed attachment) of Embodiment 1.

FIG. 7 is an explanatory diagram showing a chief elements of a structure (a state of a complete attachment) of Embodiment 1.

FIG. 7 shows a state that the media cassette 2 containing the recording media 20 is completely attached to the image forming apparatus body 1. In this state, the plate holding portion 6 of the media cassette 2 is pushed by the release portion 11 of the image forming apparatus body 1. Then, engagement of the plate holding portion 6 with the L shaped crook portion 7, is released. When the engagement is released, the recording media 20 piled and loaded on the loading plate 3, is pushed by a pushing up member 5 up to the media supplying roller 9. As a result, a second ground conducting route comprising the recording media 20, the media supplying roller 9, the image forming apparatus body 1 and a grounding point 100; is formed. Here, the media supplying roller 9 is made up of a material such as a rubber, in which fragments of electron-conductive matter such as carbon or fila are scattered. This media supplying roller 9 contacts with a conductive contacting portion formed as prolonged from a prescribed portion of the image forming apparatus body 1. And, the conductive contacting portion is connected to a grounding point 100 through a conductive portion of the image forming apparatus body 1. Then, a static electricity generated in a printing operation by a friction between the recording media 20 and the media supplying roller 9, between the recording media 20 and the separating rubber 12, or between the recording media 20 themselves; and charged on a recording medium; is discharged through the second ground conducting route including the media supplying roller 9, to a grounding point 100.

As described above, a first ground conducting route is formed, when the media cassette 2 is on a way to a position where the media cassette 2 is attached to the image forming apparatus body 1. Then, a static electricity already charged on a recording medium, is discharged through the first ground conducting route. And, a second ground conducting route is formed, when the media cassette 2 containing the recording media 20 is completely attached to the image forming apparatus body 1. Then, a static electricity generated in a printing operation and charged on a recording medium existing at top of the pile of recording media 20, is discharged through the media supplying roller 9 included in the second ground conducting route. Therefore, every static electricity charged on the media cassette 2, is completely removed. And, obtained is an effect of eliminating inconveniences such as drop of graphical quality, malfunction of the apparatus, or electric shocks to operators; which are caused by a static electricity flowing in unexpected routes as a noise of electric current.

In the description mentioned above, a first ground conducting route comprises the recording media 20, the loading plate 3, the conducting member 4 and the pushing out member 10 leading to a grounding point 100. However, the present invention is not limited to this example. That is, a static electricity to be discharged, is not limited to a static electricity charged on the recording media 20 or on the loading plate 3. But, a static electricity charged on every element in the media cassette 2, is a subject of the present invention. Therefore, a first ground conducting route can comprise all the conducting route that that is grounded through the pushing out member 10, when the media cassette 2 is on a way to a position where the media cassette 2 is attached to the image forming apparatus body 1. For example, a first ground conducting route can comprise the pushing up member 5 or the plate holding portion 6, and the loading plate 3, the conducting member 4 and the pushing out member 10 leading to a grounding point 100.

Moreover, in the description mentioned above, a first ground conducting route is formed, when the media cassette 2 is on a way to a position where the media cassette 2 is attached to the image forming apparatus body 1. However, the present invention does not limit a position of forming a first ground conducting route. That is, a first ground conducting route is continuously formed after the media cassette 2 is completely attached to the image forming apparatus body 1. And, a static electricity generated in a printing operation and charged on a recording medium existing at top of the pile of recording media 20, is discharged not only through the second ground conducting route but also through the first ground conducting route.

Embodiment 2

Configuration

Figure 8:
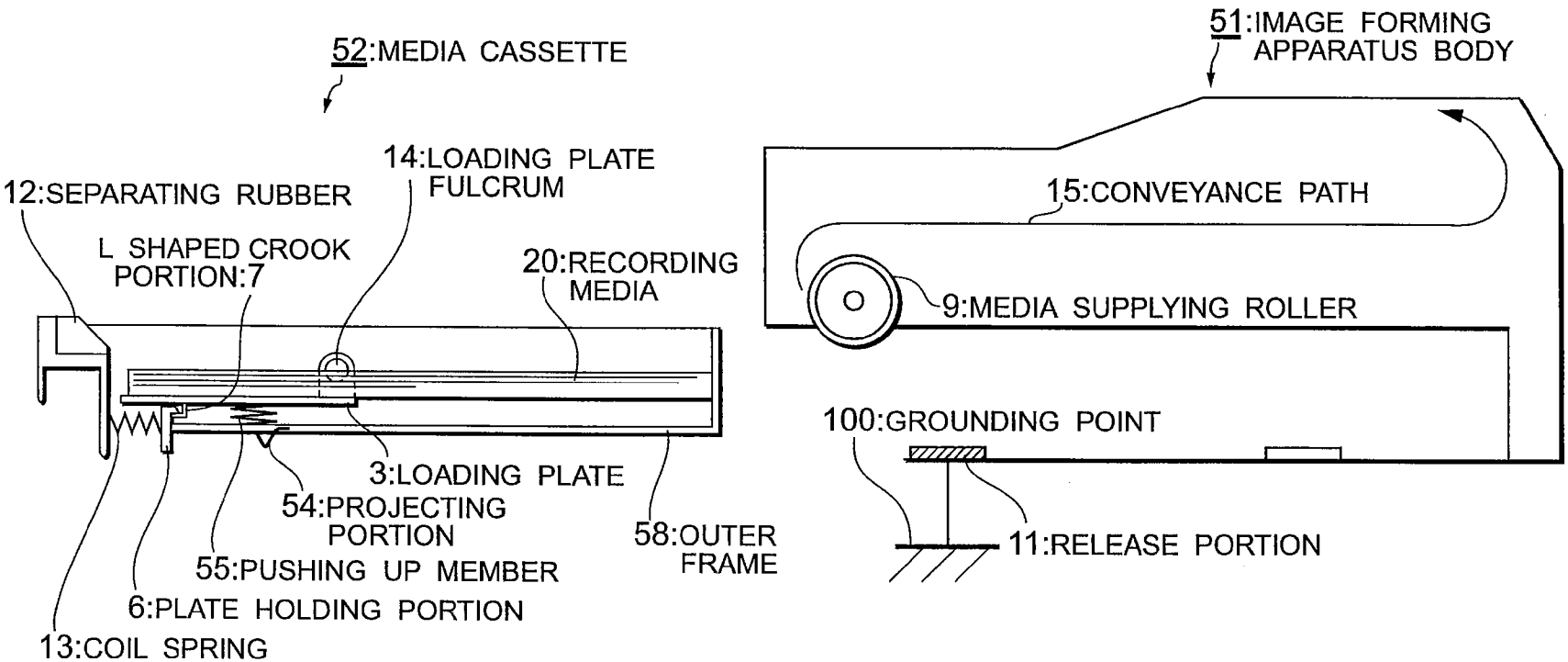
FIG. 8 is an explanatory diagram showing a chief elements of a structure (before attaching) of Embodiment 2.

FIG. 8 is an explanatory diagram showing a chief elements of a structure (before attaching) of Embodiment 2.

FIG. 8 shows a diagram of an image showing a positional relation of chief component parts only, seeing inside of an apparatus through a side wall of the apparatus' body, so as to refer to explain a structure, a function and an operation of Embodiment 2.

As shown in FIG. 8, chief component parts of Embodiment 2 are an image forming apparatus body 51 and a media cassette 52. The image forming apparatus body 51 comprises a media supplying roller 9, a release portion 11 and a conveyance path 15. The media cassette 52 (media supplying unit) comprises a loading plate 3, a pushing up member 55, a plate holding portion 6, an L shaped crook portion 7, an outer frame 58, a separating rubber 12, a coil spring 13, a loading plate fulcrum 14 and a projecting portion 54.

Chief component parts shown in FIG. 8, will be described in detail, referring to FIG. 9. The component parts in Embodiment 2 same as Embodiment 1, are designated with the same number as Embodiment 1.

Figure 9:
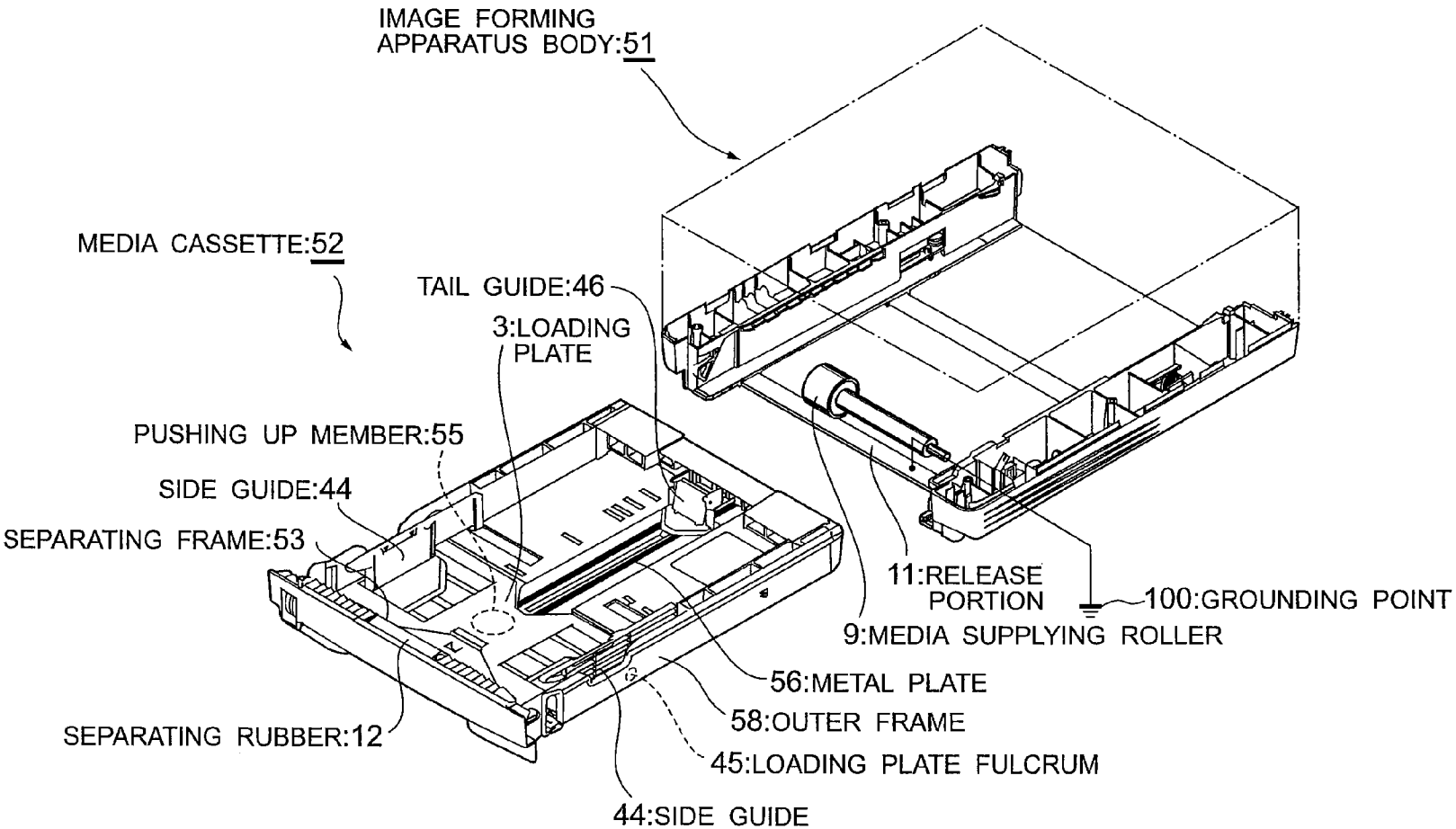
FIG. 9 is a slant viewed diagram showing a media cassette and its attaching portion of Embodiment 2.

FIG. 9 is a slant viewed diagram showing a media cassette and its attaching portion of Embodiment 2.

FIG. 9 shows a slant view of a media cassette and a slant view of a portion of an image forming apparatus body where the media cassette is attached.

A loading plate 3 is provided in the media cassette 52. And, a pile of recording media (not shown in FIG. 9) are loaded on the loading plate 3. Then, a pair of side guides 44 hold the recording media 20 (shown in FIG. 8) at longitudinal sides of them, and a tail guide 46 holds a lateral side of them, so as not to scatter in the media cassette 52.

Thus, the recording media (not shown in FIG. 9) held in the media cassette 52 and loaded on the loading plate 3, are pressed by a pushing up member 55 to the media supplying roller 9 provided in the image forming apparatus body 51, after the media cassette 52 is attached to the image forming apparatus body 51. The loading plate 3 is supported by a loading plate fulcrum 45, so as to rotate up and down around the loading plate fulcrum 45 formed at a prescribed portion of an outer frame 58. The outer frame 58 is formed by a mold with resin.

Figure 10:
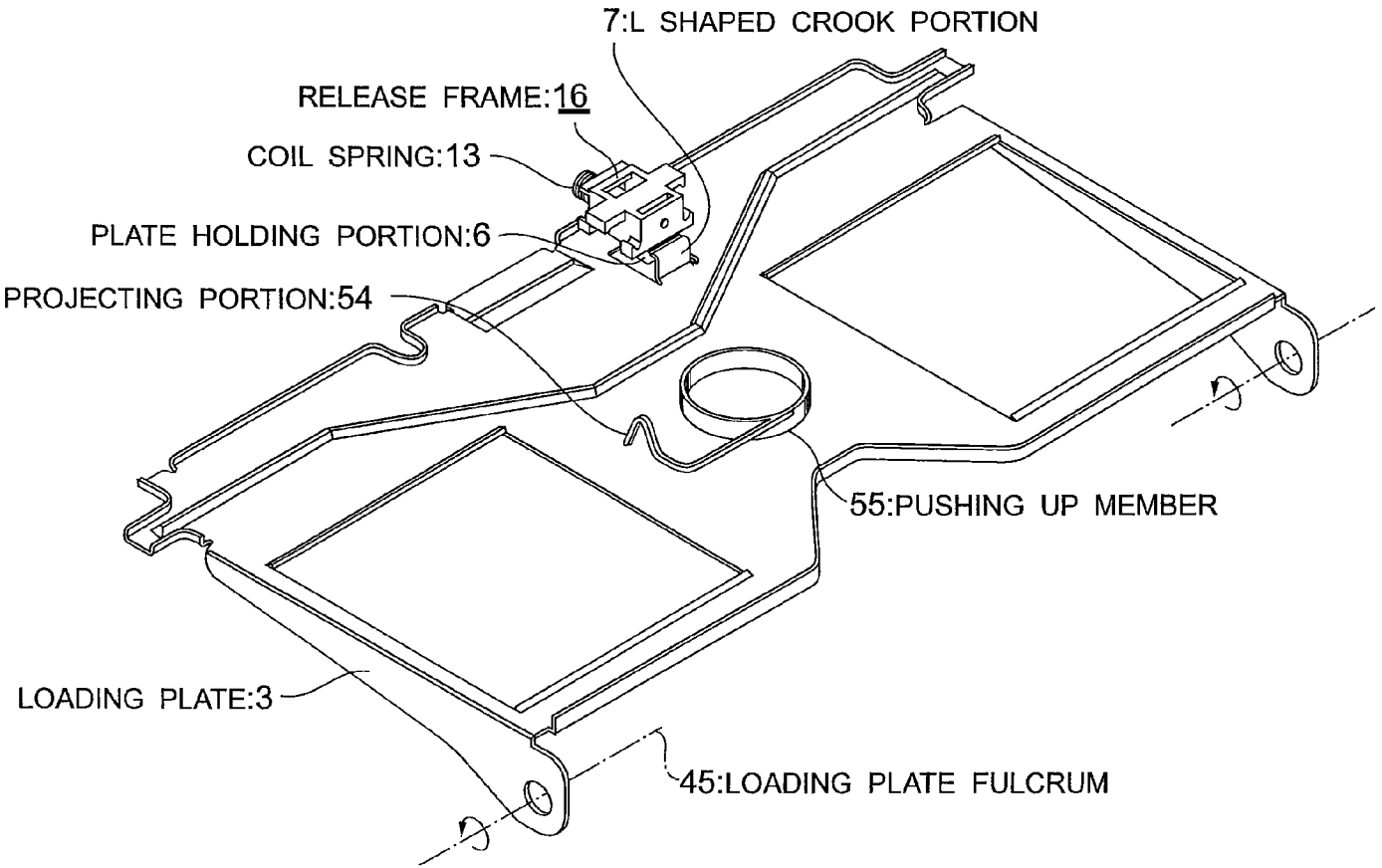
FIG. 10 is a slant viewed diagram showing a loading plate of Embodiment 2.

FIG. 10 is a slant viewed diagram showing a loading plate of Embodiment 2.

FIG. 10 shows a slanted view of a backside of the loading plate 3 which is taken apart from the image forming apparatus body 51.

As shown in FIG. 10, a loading plate 3 with a pile of recording media 20 is pressed to a media supplying roller 9 by a pushing up member 55 comprising a coil spring. A projecting member 54 is formed at an end of the pushing up member 55. The projecting member 54 contacts with a metal plate 56 shown in FIG. 9 provided on an inner base of the outer frame 58. Thus, a static electricity charged on the recording media flows to the projecting portion 54.

Moreover, a release frame 16 is made for containing a force of a pushing up member 55 by engaging a plate holding portion 6 with an L shaped crook portion 7 formed on the backside of the loading plate 3, when the media cassette 52 is not attached to the image forming apparatus body 51. Here, the release frame 16 with the plate holding portion 6 is provided at a prescribed portion of an outer frame (shown in FIG. 9). When the media cassette 52 is attached to the image forming apparatus body 51, a release portion 11 formed on an inner base of the image forming apparatus body 51 (shown in FIG. 8) releases the engagement between the plate holding portion 6 and the L shaped crook portion 7, with pressing a coil spring 13.

Returning to FIG. 8, a function and an operation of Embodiment 2 will be described.

As shown in FIG. 8, the recording media 20 are loaded on the loading plate 3 piling up on it. The recording media 20 are held by a pair of side guides 44 (FIG. 9) at longitudinal sides. And, they are held by a tail guide 46 at a lateral side. Thus, they do not scatter in the media cassette 52. In FIG. 8, a force of a pushing up member 55 is contained by engaging a plate holding portion 6 with an L shaped crook portion 7 formed on the backside of the loading plate 3, as the media cassette 52 is not attached to the image forming apparatus body 51.

A portion of the recording media 20 contacts with the metal plate 56.

Figure 11:
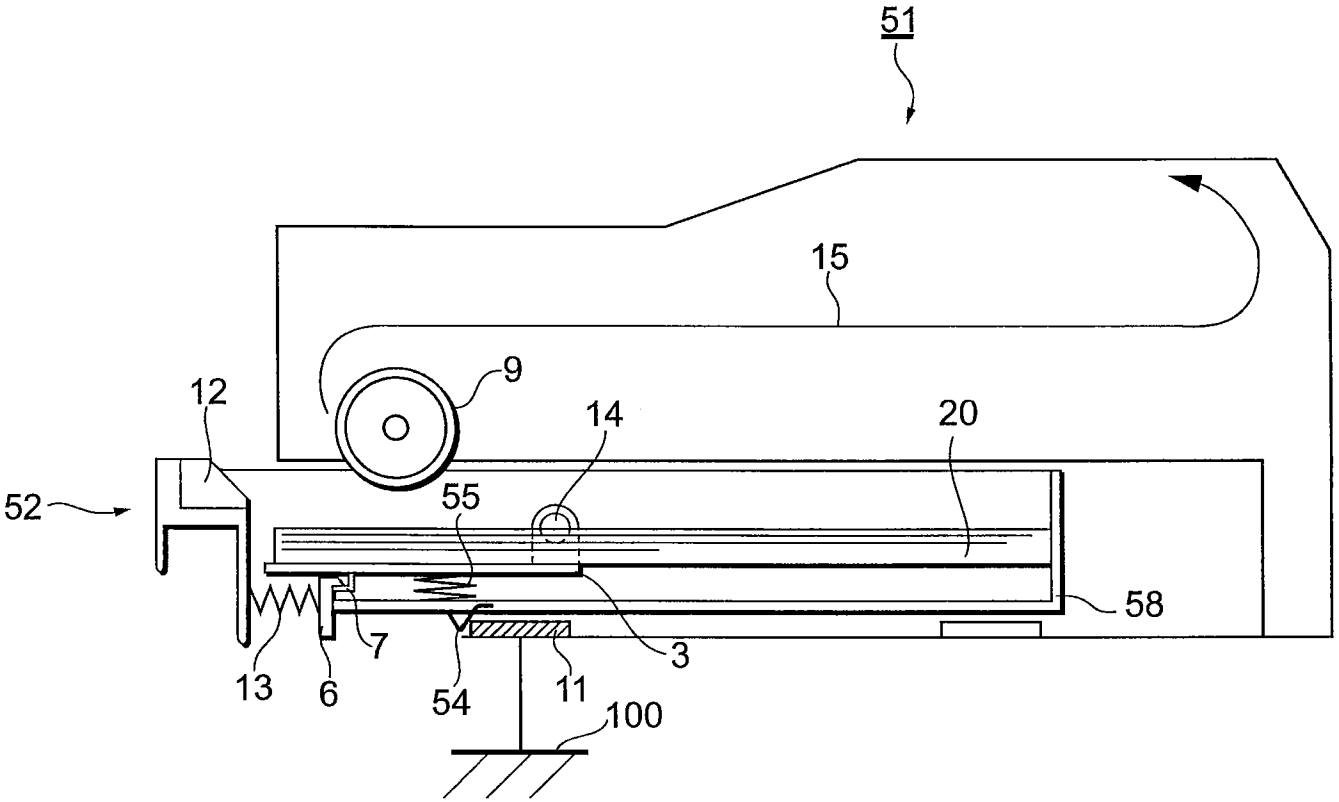
FIG. 11 is an explanatory diagram showing a chief elements of a structure (a first state of combination) of Embodiment 2.

FIG. 11 is an explanatory diagram showing a chief elements of a structure (a first state of combination) of Embodiment 2.

FIG. 11 shows a state that a projecting portion 54 of the media cassette 52 contacts with a release portion 11 of the image forming apparatus body 51, when the media cassette 52 is on a way to a position where the media cassette 52 is attached to the image forming apparatus body 51 (a first state of combination).

In the first state of combination, a first ground conducting route comprising the recording media 20, the loading plate 3, the metal plate 56 (shown in FIG. 9), the projecting portion 54 and the release portion 11; is formed. A static electricity already charged before the attachment, on a recording medium or in the media cassette 52 including the loading plate 3, is discharged through the first ground conducting route to a grounding point 100.

Figure 12:
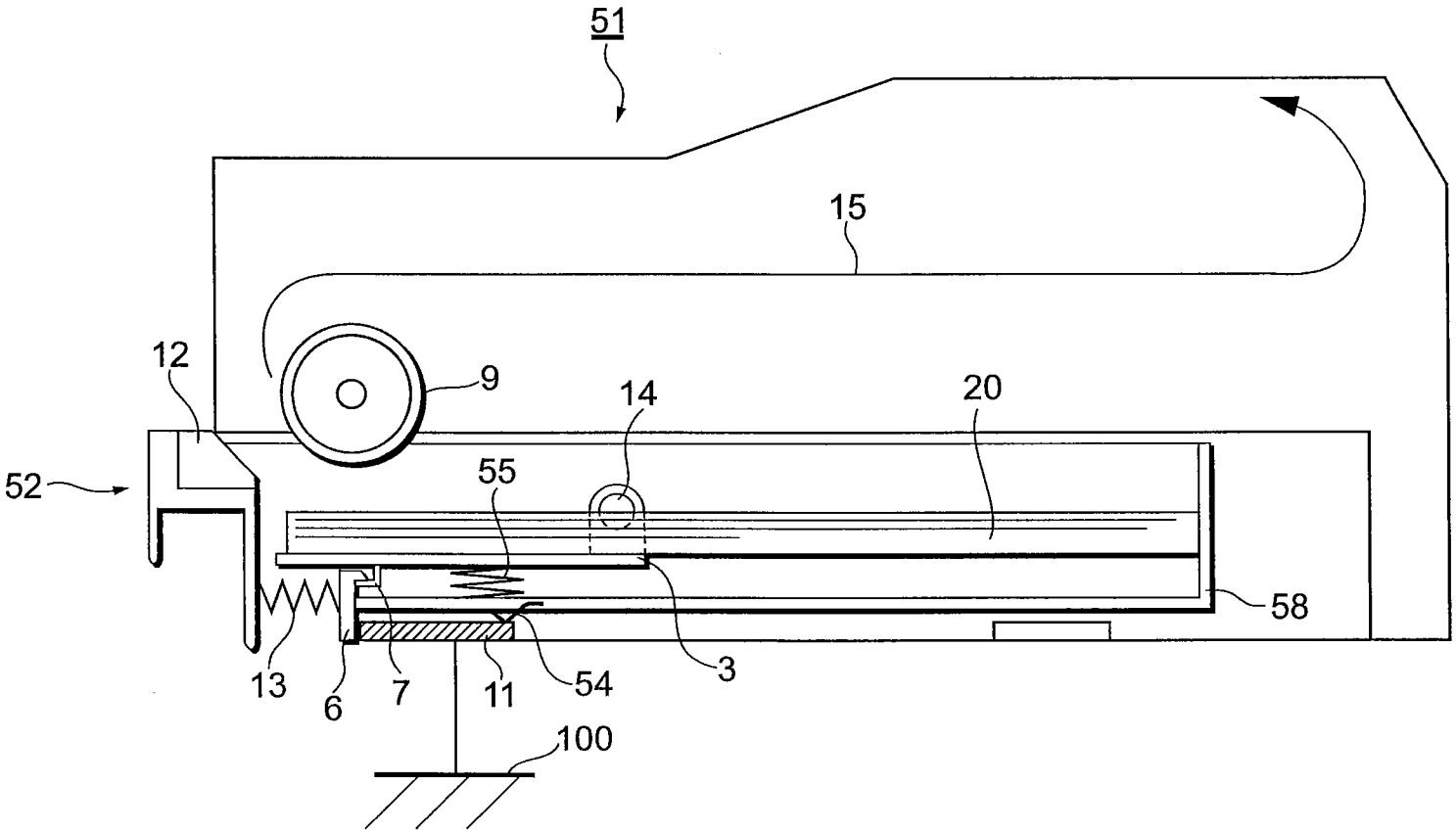
FIG. 12 is an explanatory diagram showing a chief elements of a structure (a second state of combination) of Embodiment 2.

FIG. 12 is an explanatory diagram showing a chief elements of a structure (a second state of combination) of Embodiment 1.

FIG. 12 shows a state that a plate holding portion 6 of the media cassette 52 contacts with a release portion 11 of the image forming apparatus body 51, when the media cassette 52 is still on a way near to a position where the media cassette 52 is attached to the image forming apparatus body 51 (a second state of combination).

In the second state of combination, the recording media 20 does not contact with a media supplying roller 9 yet, because a force of a pushing up member 55 is contained by engaging a plate holding portion 6 with an L shaped crook portion 7 formed on the backside of the loading plate 3.

Figure 13:
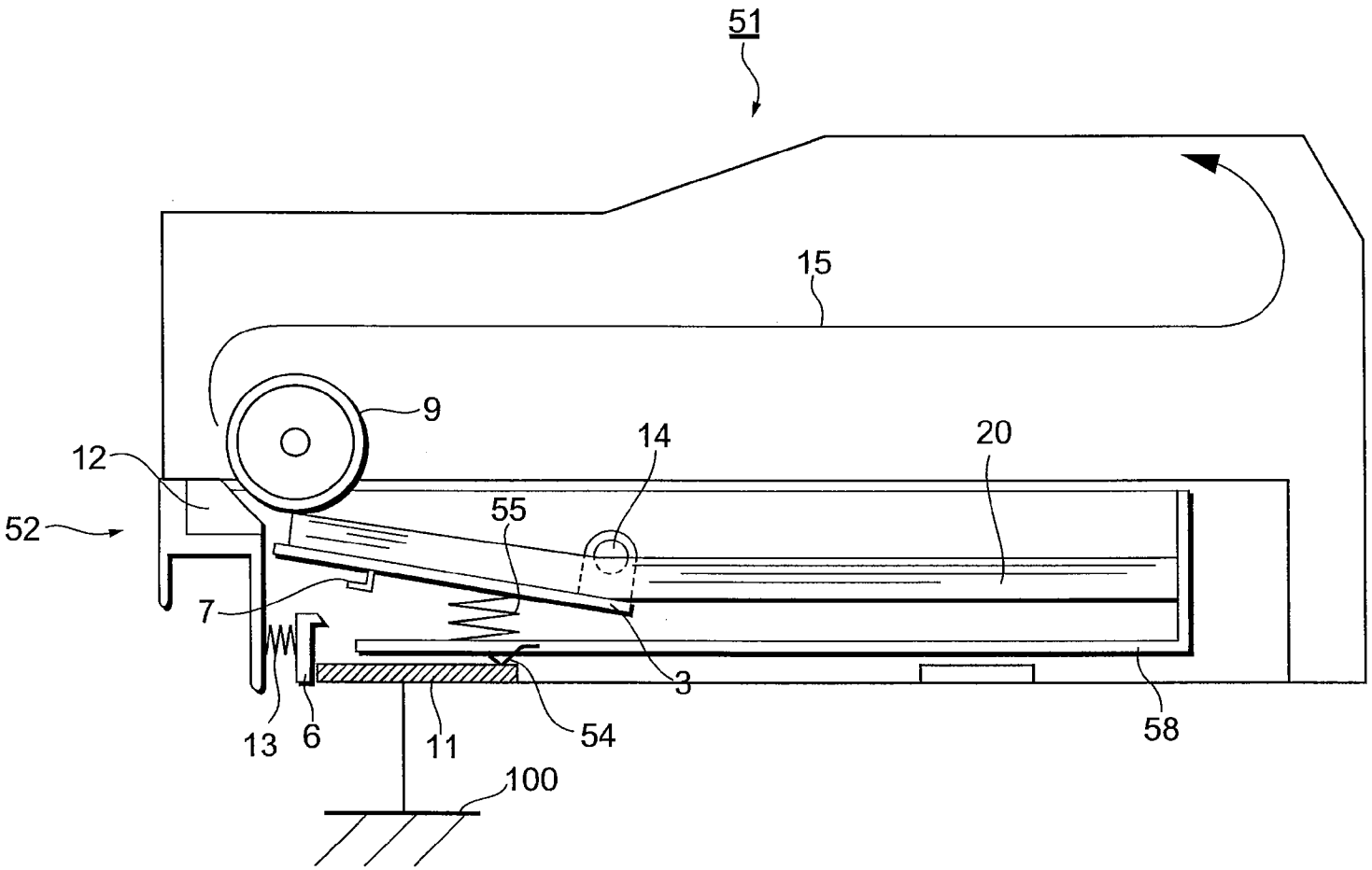
FIG. 13 is an explanatory diagram showing a chief elements of a structure (a state of completed attachment) of Embodiment 2.

FIG. 13 is an explanatory diagram showing a chief elements of a structure (a state of a complete attachment) of Embodiment 2.

FIG. 13 shows a state that the media cassette 2 containing the recording media 20 is completely attached to the image forming apparatus body 51. In this state, the plate holding portion 6 of the media cassette 52 is pushed by the release portion 11 of the image forming apparatus body 51. Then, engagement of the plate holding portion 6 with the L shaped crook portion 7, is released. When the engagement is released, the recording media 20 piled and loaded on the loading plate 3, is pushed by a pushing up member 55 up to the media supplying roller 9. As a result, a second ground conducting route comprising the recording media 20, the media supplying roller 9, the image forming apparatus body 51 and a grounding point 100; is formed. Then, a static electricity generated in a printing operation by a friction between the recording media 20 and the media supplying roller 9, between the recording media 20 and the separating rubber 12, or between the recording media 20 themselves; and charged on a recording medium; is discharged through the second ground conducting route including the media supplying roller 9, to a grounding point 100.

As described above, Embodiment 2 obtains an effect that the number of component parts can be decreased in addition to the same effect as Embodiment 1, because a metal plate is provided on an inner base of the media cassette in Embodiment 2, instead of a conducting plate 4 in Embodiment 1.

Embodiment 3

Configuration

Figure 14:
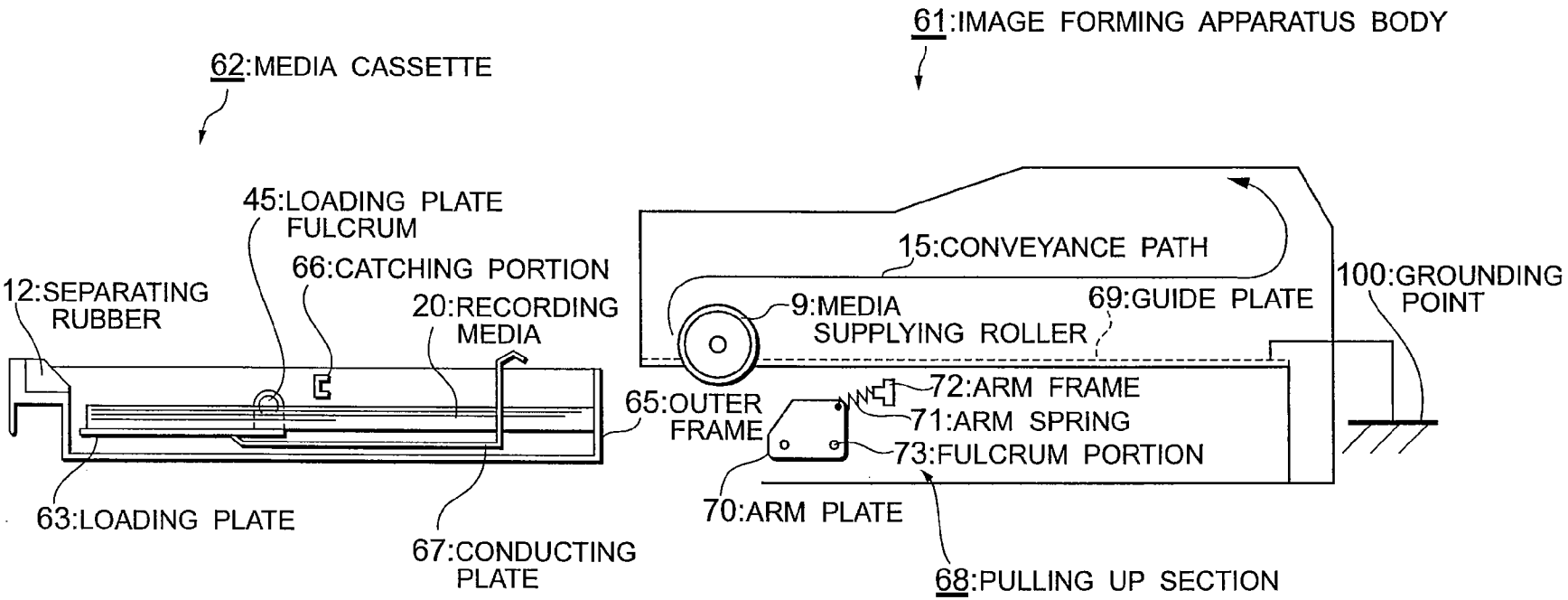
FIG. 14 is an explanatory diagram showing a chief elements of a structure (before attaching) of Embodiment 3.

FIG. 14 is an explanatory diagram showing a chief elements of a structure (before attaching) of Embodiment 3.

FIG. 14 shows a diagram of an image showing a positional relation of chief component parts only, seeing inside of an apparatus through a side wall of the apparatus' body, so as to refer to explain a structure, a function and an operation of Embodiment 3.

As shown in FIG. 14, chief component parts of Embodiment 3 are an image forming apparatus body 61 and a media cassette 62. The image forming apparatus body 61 comprises a media supplying roller 9, a conveyance path 15, a pulling up section 68 and a guide plate 69. The pulling up section 68 comprises an arm plate 70, an arm spring 71, an arm frame 72 and a fulcrum portion 73. The media cassette 62 comprises a loading plate 63, an outer frame 65, a separating rubber 12, a loading plate fulcrum 45, a catching portion 66 and a conducting plate 67.

Chief component parts shown in FIG. 14, will be described in detail, referring to FIG. 15. The component parts in Embodiment 3 same as Embodiment 1, are designated with the same number as Embodiment 1.

Figure 15:
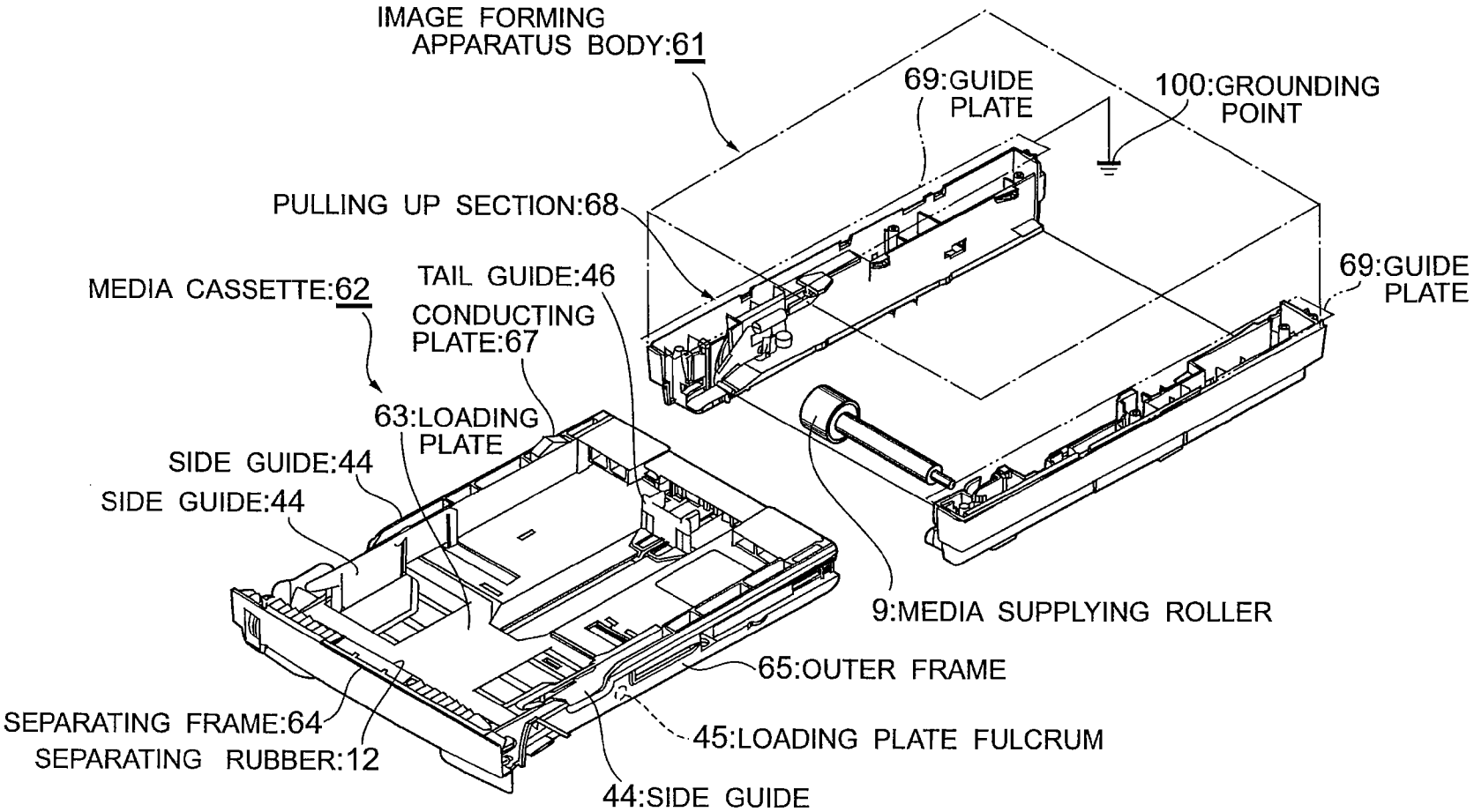
FIG. 15 is a slant viewed diagram showing a media cassette and its attaching portion of Embodiment 3.

FIG. 15 is a slant viewed diagram showing a media cassette and its attaching portion of Embodiment 3.

FIG. 15 shows a slant view of a media cassette and a slant view of a portion of an image forming apparatus body where the media cassette is attached.

A loading plate 63 is provided in the media cassette 62. And, a pile of recording media (not shown in FIG. 15) are loaded on the loading plate 63. Then, a pair of side guides 44 hold the recording media 20 (shown in FIG. 14) at longitudinal sides of them, and a tail guide 46 holds a lateral side of them, so as not to scatter in the media cassette 62.

Thus, the recording media (not shown in FIG. 15) held in the media cassette 62 and loaded on the loading plate 63, are pressed by a pulling up section 68 of the image forming apparatus body 61, to the media supplying roller 9 provided in the image forming apparatus body 61, after the media cassette 62 is attached to the image forming apparatus body 61. The pulling up section 68 is provided at each of left and right side of the image forming apparatus body 61. The loading plate 63 is supported by a loading plate fulcrum 45, so as to rotate up and down around the loading plate fulcrum 45 formed at a prescribed portion of an outer frame 65. The outer frame 65 is formed by a mold with resin.

Figure 16:
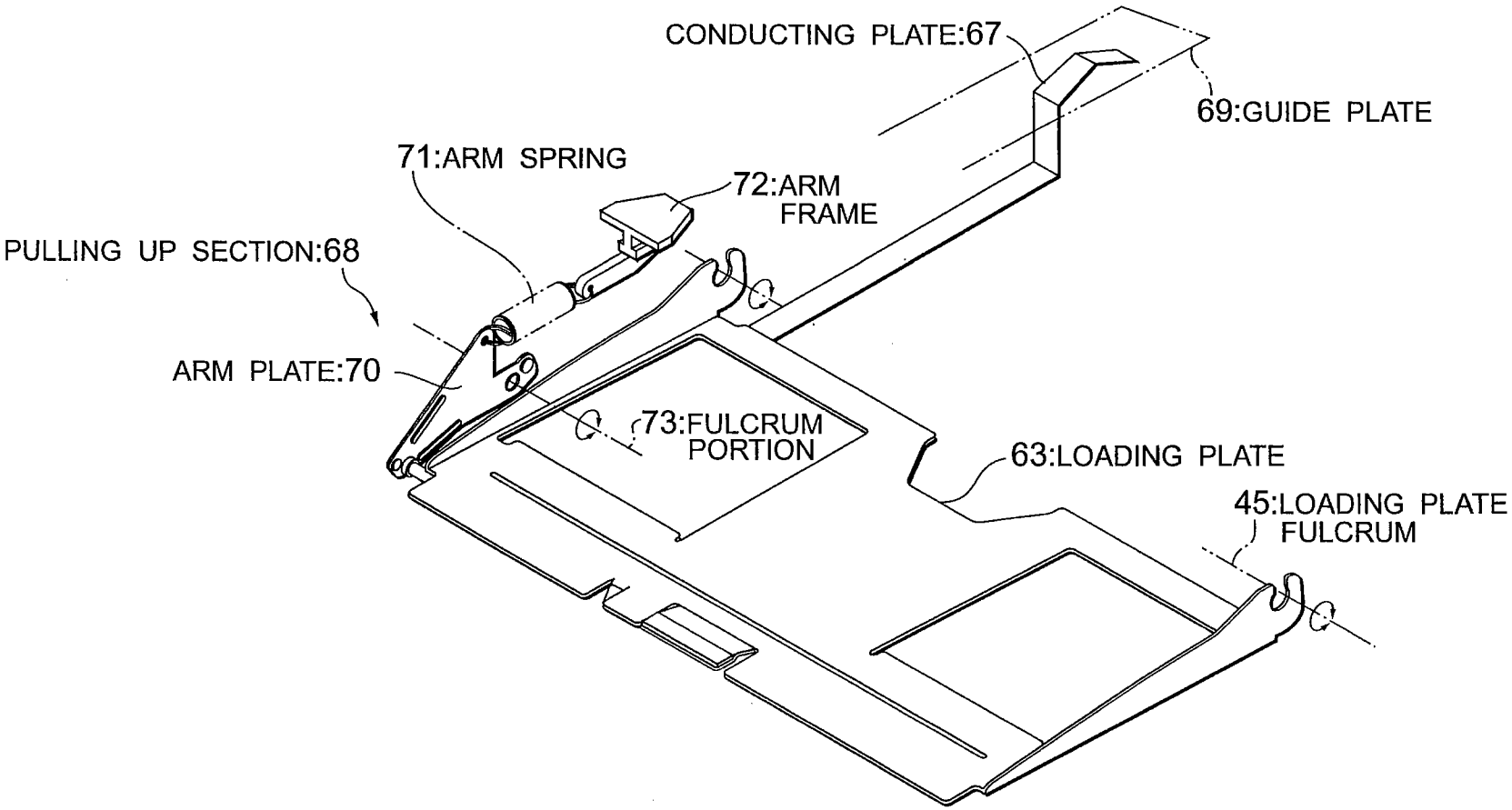
FIG. 16 is a slant viewed diagram showing a loading plate of Embodiment 3.

FIG. 16 is a slant viewed diagram showing a loading plate of Embodiment 3.

FIG. 16 shows a slanted view of a backside of the loading plate 63 which is taken apart from the image forming apparatus body 61.

As shown in FIG. 16, a loading plate 63 comprises an arm plate 70, an arm spring 71 and an arm frame 72. And, the loading plate 63 with a pile of recording media 20 is pressed to a media supplying roller 9 by a pulling up section 68 of the image forming apparatus body 61. In the pulling up section 68, an arm frame 72 is pushed by a catching portion 66 formed on both side walls of the media cassette 62 (c.f. FIG. 14). Then, an arm spring 71 is pulled, so as to rotate an arm plate 70 around a fulcrum portion 73.

A conducting plate 67 comprising a conducting material of metal prolonged under the loading plate 63 in a direction of attaching the media cassette 62, is provided in the media cassette 62. An end of the conducting plate 67 touches a base of the loading plate 63 loading the recording media 20 (c.f. FIG. 14). The other end of the conducting plate 67 prolonged upward of the media cassette 62, touches a guide plate 69. Then, a static electricity charged on the recording media 20 flows to a guide plate 69 provided at a prescribed portion of the image forming apparatus body 61. The guide plate 69 is made of a metal plate.

Returning to FIG. 14, a function and an operation of Embodiment 3 will be described.

As shown in FIG. 14, the recording media 20 are loaded on the loading plate 63 piling up on it. The recording media 20 are held by a pair of side guides 44 (FIG. 15) at longitudinal sides. And, they are held by a tail guide 46 at a lateral side. Thus, they do not scatter in the media cassette 62. In FIG. 14, a force of a pulling up section 68 does not operate on the loading plate 63, as the media cassette 62 is not attached to the image forming apparatus body 61.

Figure 17:
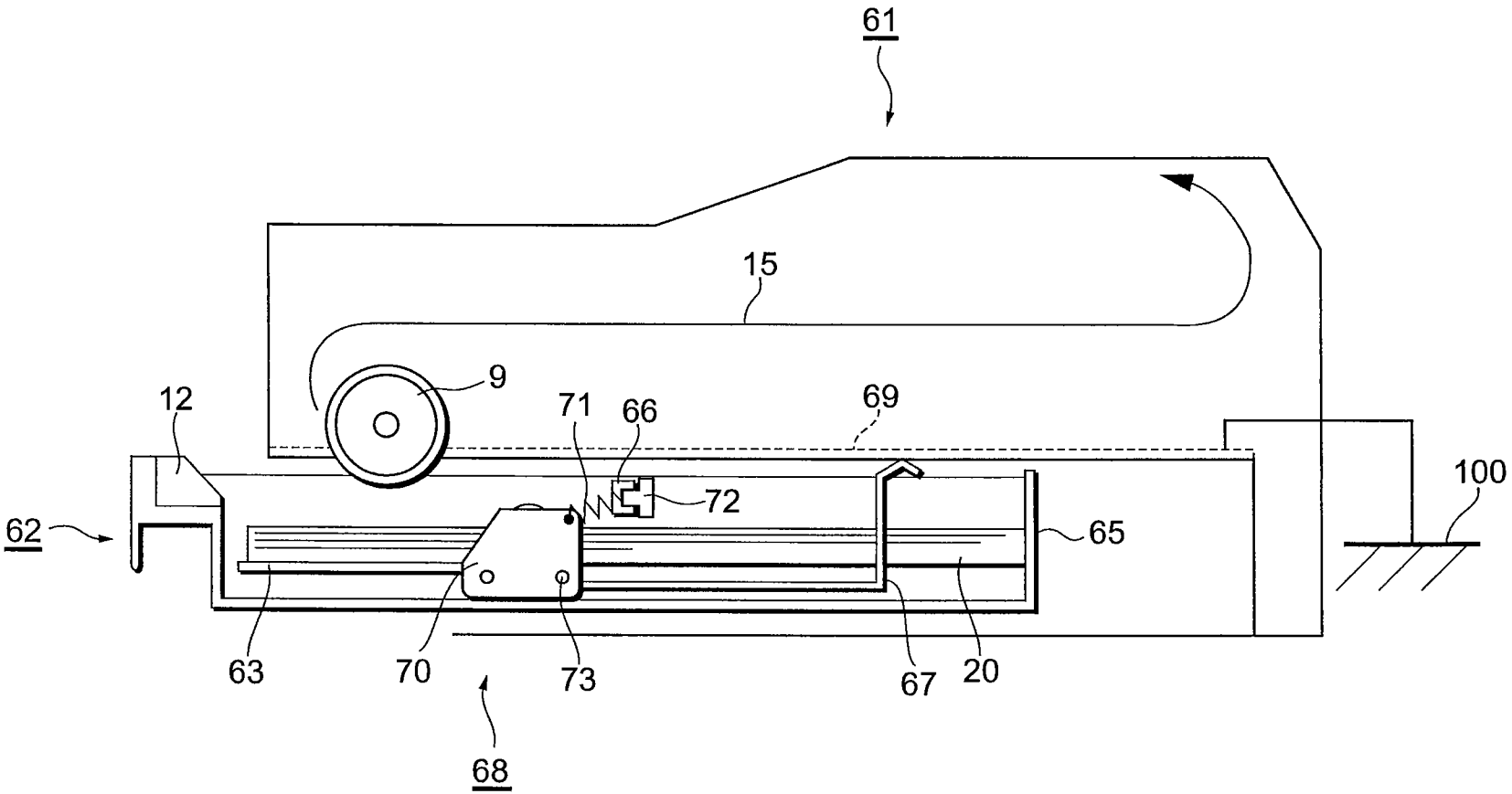
FIG. 17 is an explanatory diagram showing a chief elements of a structure (a first state of combination) of Embodiment 3.

FIG. 17 is an explanatory diagram showing a chief elements of a structure (a first state of combination) of Embodiment 3.

FIG. 17 shows a state that a catching portion 66 formed on both side walls of the media cassette 62 contacts with an arm frame 72 of the pulling up section 68 of the image forming apparatus body 61, when the media cassette 62 is on a way to a position where the media cassette 62 is attached to the image forming apparatus body 61 (a first state of combination).

In the first state of combination, a first ground conducting route comprising the recording media 20, the loading plate 63, the conducting plate 67 and the guide plate 69; is formed. A static electricity already charged before the attachment, on a recording medium or in the media cassette 62 including the loading plate 63, is discharged through the first ground conducting route to a grounding point 100.

Figure 18:
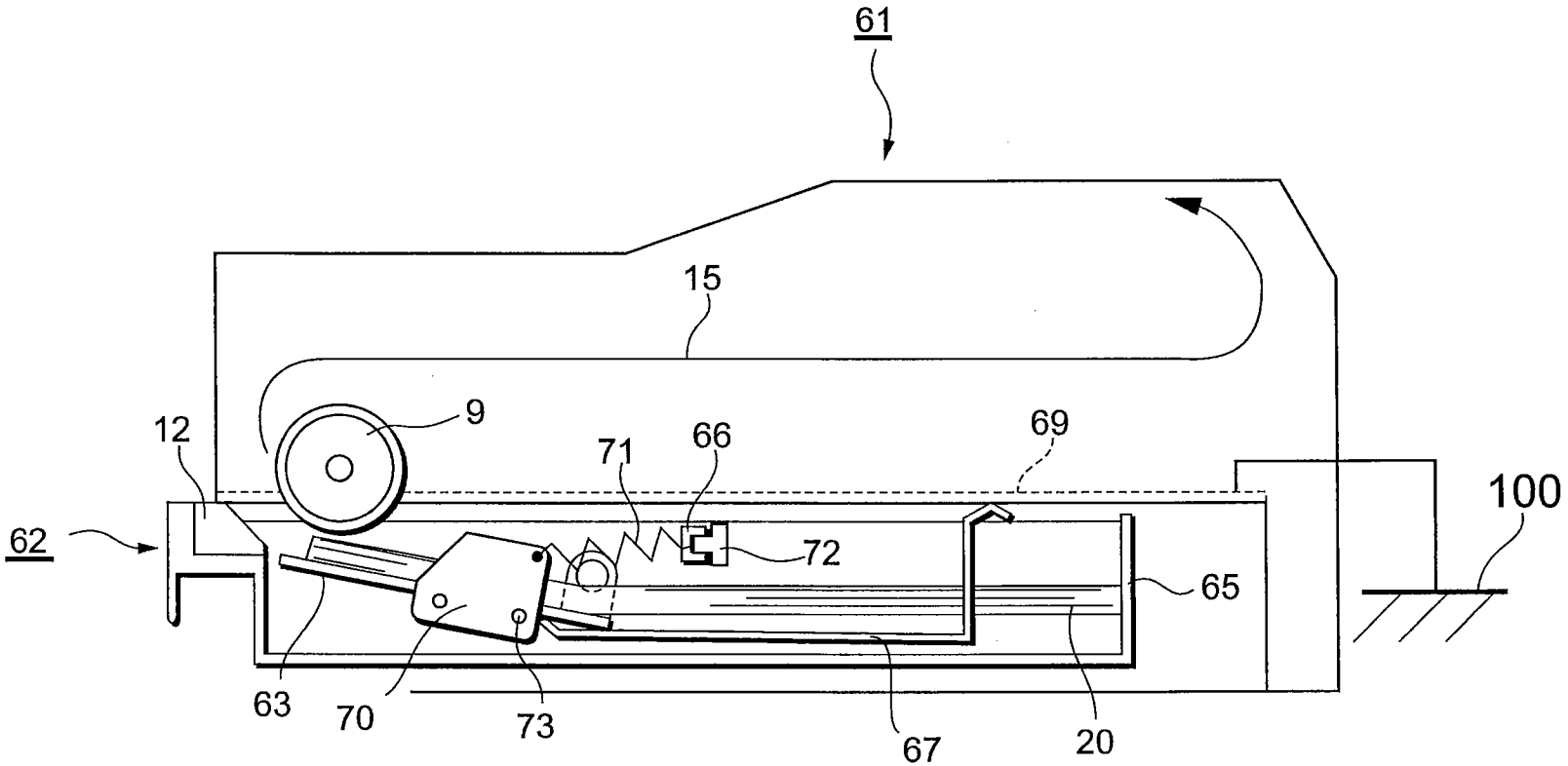
FIG. 18 is an explanatory diagram showing a chief elements of a structure (a second state of combination) of Embodiment 3.

FIG. 18 is an explanatory diagram showing a chief elements of a structure (a second state of combination) of Embodiment 2.

FIG. 18 shows a state that a catching portion 66 formed on both side walls of the media cassette 62 pushes an arm frame 72 of the pulling up section 68 of the image forming apparatus body 61, when the media cassette 62 is still on a way near to a position where the media cassette 62 is attached to the image forming apparatus body 61. As a result, in the pulling up section 68, an arm spring 71 is pulled, so as to begin rotating an arm plate 70 around a fulcrum portion 73 (a second state of combination).

In the second state of combination, the recording media 20 does not contact with a media supplying roller 9 yet.

Figure 19:
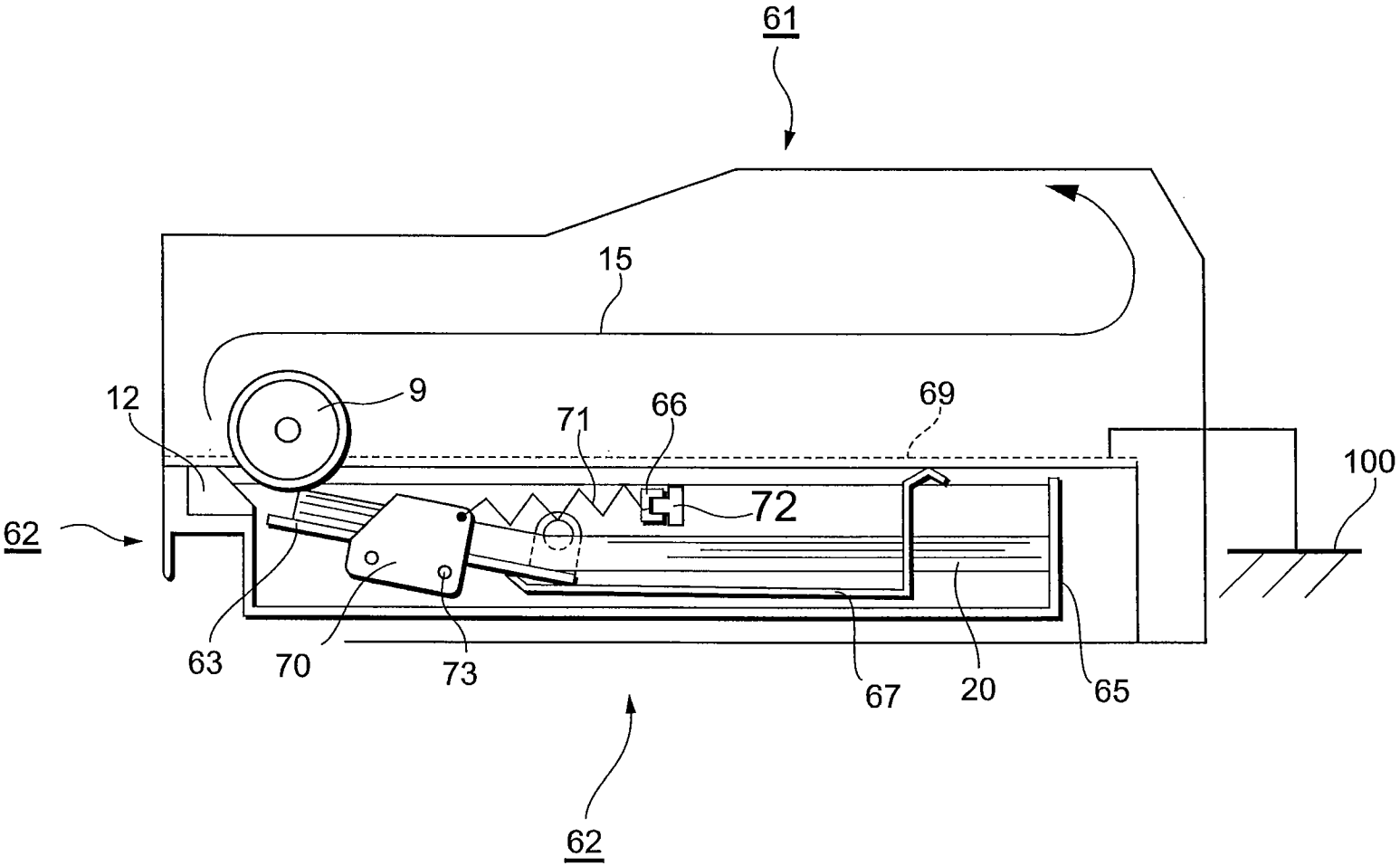
FIG. 19 is an explanatory diagram showing a chief elements of a structure (a state of completed attachment) of Embodiment 3.

FIG. 19 is an explanatory diagram showing a chief elements of a structure (a state of a complete attachment) of Embodiment 3.

FIG. 19 shows a state that the media cassette 62 containing the recording media 20 is completely attached to the image forming apparatus body 61. In this state, in the pulling up section 68, an arm spring 71 is pulled, so as to rotate an arm plate 70 around a fulcrum portion 73. As a result, the recording media 20 piled and loaded on the loading plate 63, is pulled by the pulling up section 68 up to the media supplying roller 9. And, a second ground conducting route comprising the recording media 20, the media supplying roller 9, the image forming apparatus body 61 and a grounding point 100; is formed. Then, a static electricity generated in a printing operation by a friction between the recording media 20 and the media supplying roller 9, between the recording media 20 and the separating rubber 12, or between the recording media 20 themselves; and charged on a recording medium; is discharged through the second ground conducting route including the media supplying roller 9, to a grounding point 100.

As described above, Embodiment 3 obtains an effect that the number of component parts can be decreased in addition to the same effect as Embodiment 1, because a pulling up section is provided at an image forming apparatus body 61, and a plate holding portion 6, an L shaped crook portion 7, a coil spring 13 and a release frame 16 are omitted at a media cassette 62 in Embodiment 3.

Embodiment 4

Configuration

Figure 20:
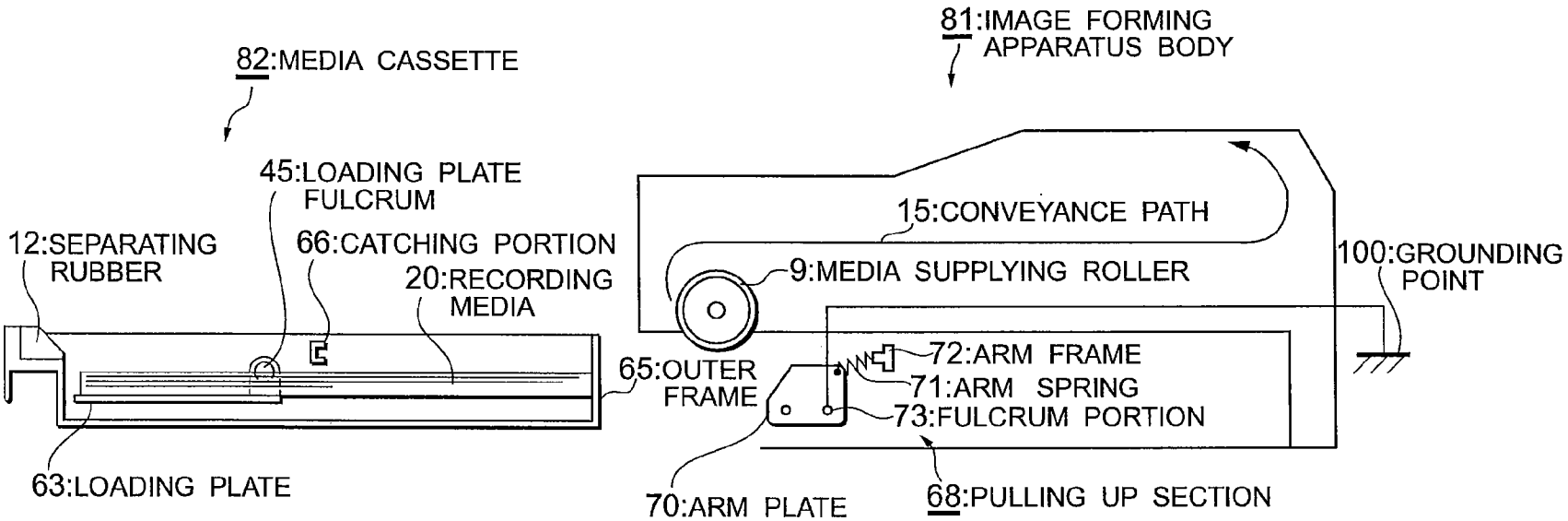
FIG. 20 is an explanatory diagram showing a chief elements of a structure (before attaching) of Embodiment 4.

FIG. 20 is an explanatory diagram showing a chief elements of a structure (before attaching) of Embodiment 4.

FIG. 20 shows a diagram of an image showing a positional relation of chief component parts only, seeing inside of an apparatus through a side wall of the apparatus' body, so as to refer to explain a structure, a function and an operation of Embodiment 4.

As shown in FIG. 20, chief component parts of Embodiment 4 are an image forming apparatus body 81 and a media cassette 82. The image forming apparatus body 81 comprises a media supplying roller 9, a conveyance path 15 and a pulling up section 68. The pulling up section 68 comprises an arm plate 70, an arm spring 71, an arm frame 72 and a fulcrum portion 73. The media cassette 62 comprises a loading plate 63, an outer frame 65, a separating rubber 12, a loading plate fulcrum 45, a catching portion 66 and a conducting plate 67.

Chief component parts shown in FIG. 20, will be described in detail, referring to FIG. 21. The component parts in Embodiment 4 same as Embodiment 1 to 3, are designated with the same number as Embodiment 1 to 3.

Figure 21:
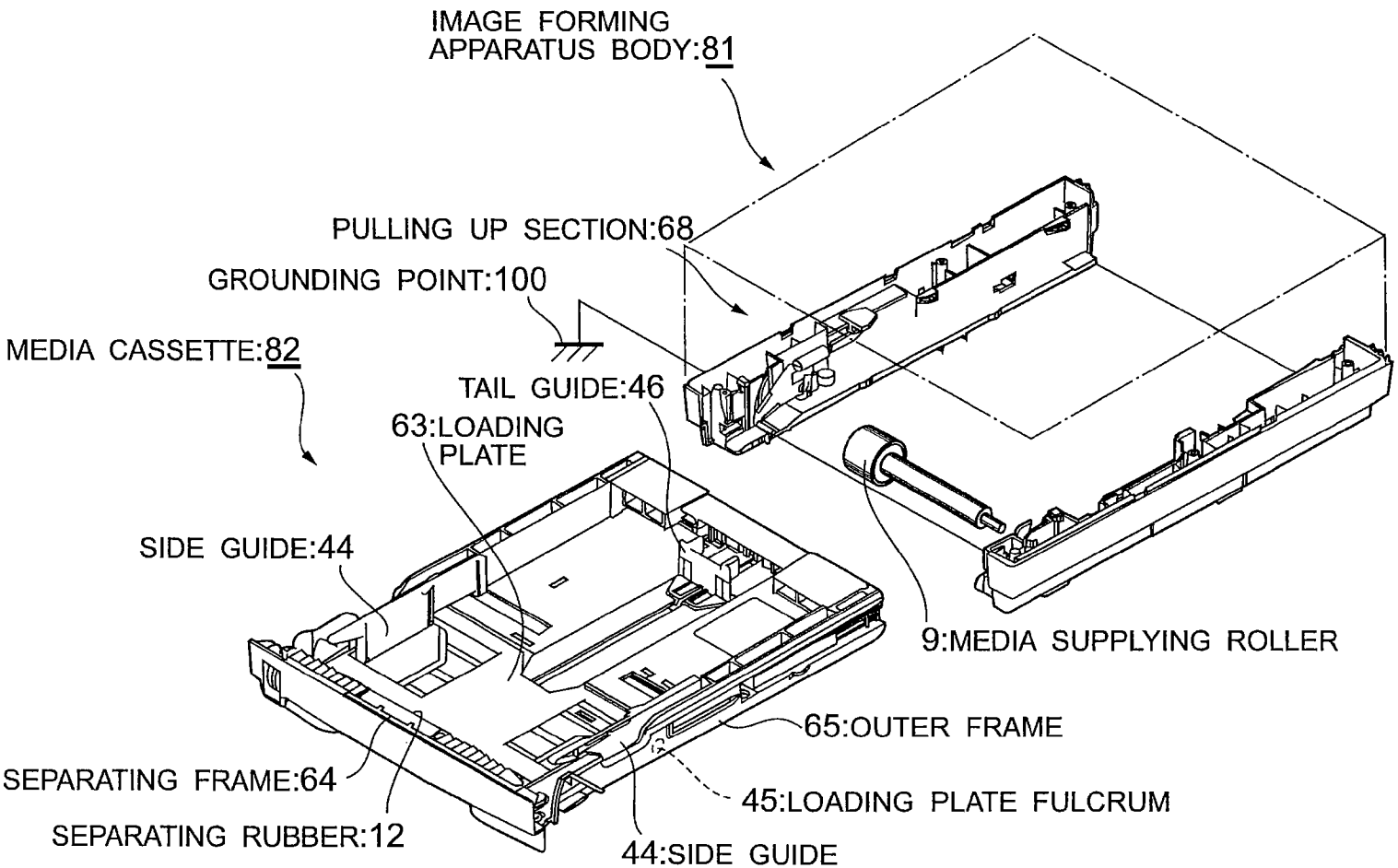
FIG. 21 is a slant viewed diagram showing a media cassette and its attaching portion of Embodiment 4.

FIG. 21 is a slant viewed diagram showing a media cassette and its attaching portion of Embodiment 4.

FIG. 21 shows a slant view of a media cassette and a slant view of a portion of an image forming apparatus body where the media cassette is attached.

A loading plate 63 is provided in the media cassette 82. And, a pile of recording media (not shown in FIG. 21) are loaded on the loading plate 63. Then, a pair of side guides 44 hold the recording media 20 (shown in FIG. 20) at longitudinal sides of them, and a tail guide 46 holds a lateral side of them, so as not to scatter in the media cassette 82.

Thus, the recording media (not shown in FIG. 21) held in the media cassette 82 and loaded on the loading plate 63, are pressed by a pulling up section 68 of the image forming apparatus body 61, to the media supplying roller 9 provided in the image forming apparatus body 61, after the media cassette 62 is attached to the image forming apparatus body 61. The loading plate 63 is supported by a loading plate fulcrum 45, so as to rotate up and down around the loading plate fulcrum 45 formed at a prescribed portion of an outer frame 65. The outer frame 65 is formed by a mold with resin.

Figure 22:
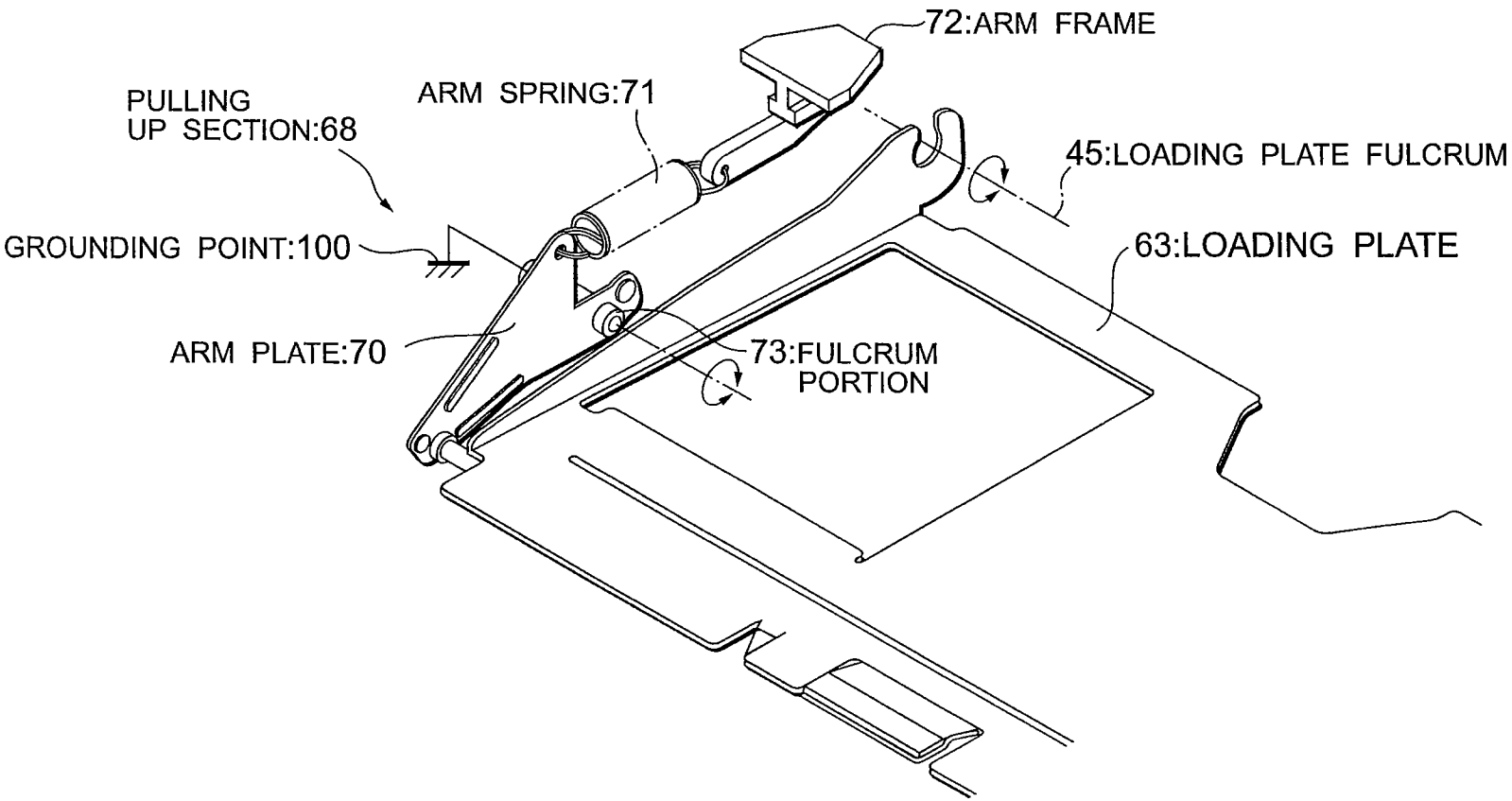
FIG. 22 is a slant viewed diagram showing a loading plate of Embodiment 4.

FIG. 22 is a slant viewed diagram showing a loading plate of Embodiment 4.

FIG. 22 shows a slanted view of a backside of the loading plate 63 which is taken apart from the image forming apparatus body 81.

As shown in FIG. 22, a loading plate 63 comprises an arm plate 70, an arm spring 71 and an arm frame 72. And, the loading plate 63 with a pile of recording media 20 is pressed to a media supplying roller 9 by a pulling up section 68 of the image forming apparatus body 61. In the pulling up section 68, an arm frame 72 is pushed by a catching portion 66 formed on both side walls of the media cassette 62 (c.f. FIG. 14). Then, an arm spring 71 is pulled, so as to rotate an arm plate 70 around a fulcrum portion 73. The fulcrum portion 73 of the pulling up section 68 is connected to a grounding point 100.

Returning to FIG. 20, a function and an operation of Embodiment 4 will be described.

As shown in FIG. 20, the recording media 20 are loaded on the loading plate 63 piling up on it. The recording media 20 are held by a pair of side guides 44 (FIG. 21) at longitudinal sides.

And, they are held by a tail guide 46 at a lateral side. Thus, they do not scatter in the media cassette 82. In FIG. 20, a force of a pulling up section 68 does not operate on the loading plate 63, as the media cassette 62 is not attached to the image forming apparatus body 61.

Figure 23:
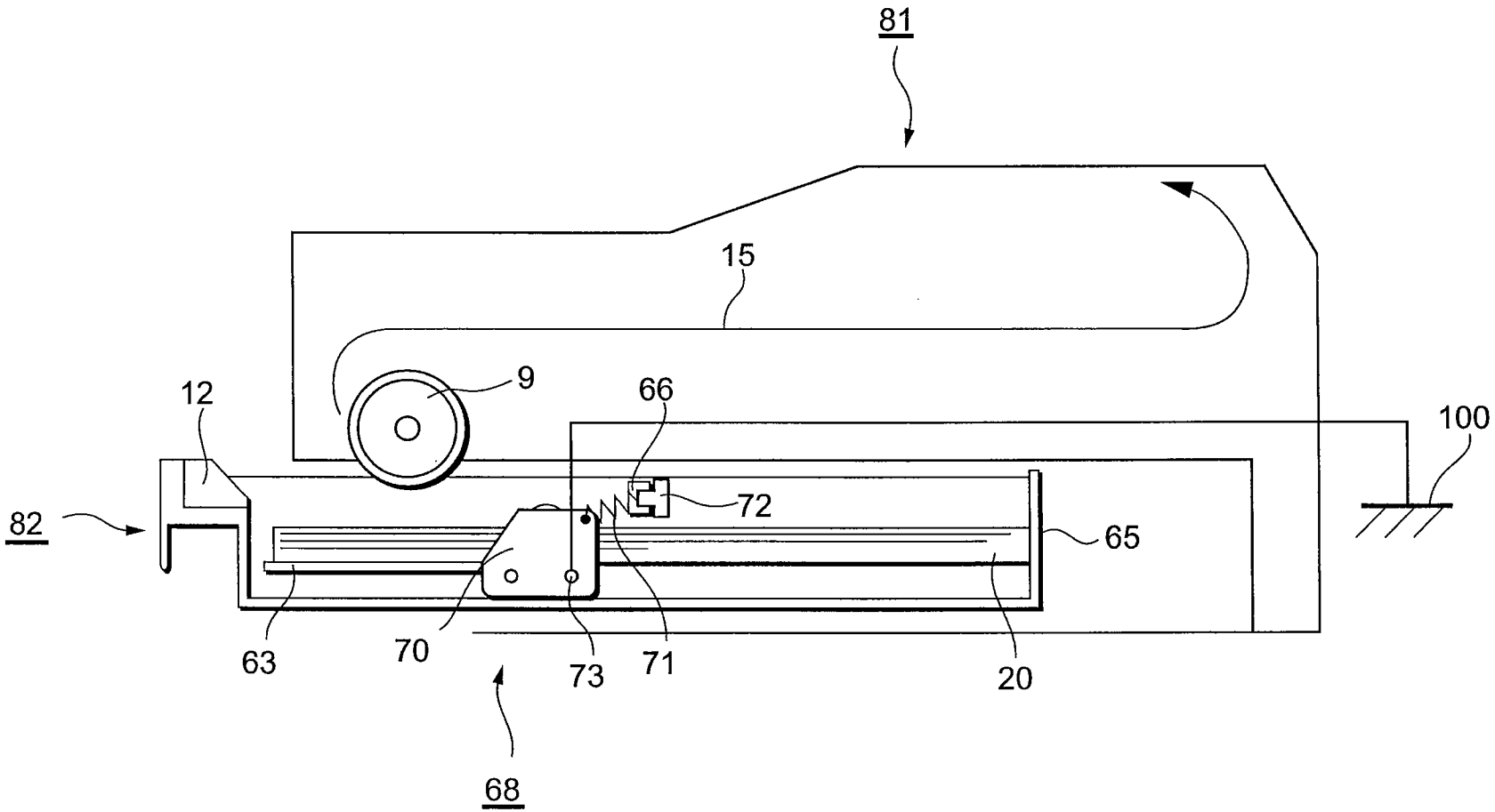
FIG. 23 is an explanatory diagram showing a chief elements of a structure (a first state of combination) of Embodiment 4.

FIG. 23 is an explanatory diagram showing a chief elements of a structure (a first state of combination) of Embodiment 4.

FIG. 23 shows a state that a catching portion 66 formed on both side walls of the media cassette 82 contacts with an arm frame 72 of the pulling up section 68 of the image forming apparatus body 81, when the media cassette 82 is on a way to a position where the media cassette 82 is attached to the image forming apparatus body 81 (a first state of combination).

In the first state of combination, a first ground conducting route comprising the recording media 20, the loading plate 63 and the fulcrum portion 73; is formed. A static electricity already charged before the attachment, on a recording medium or in the media cassette 82 including the loading plate 63, is discharged through the first ground conducting route to a grounding point 100.

Figure 24:
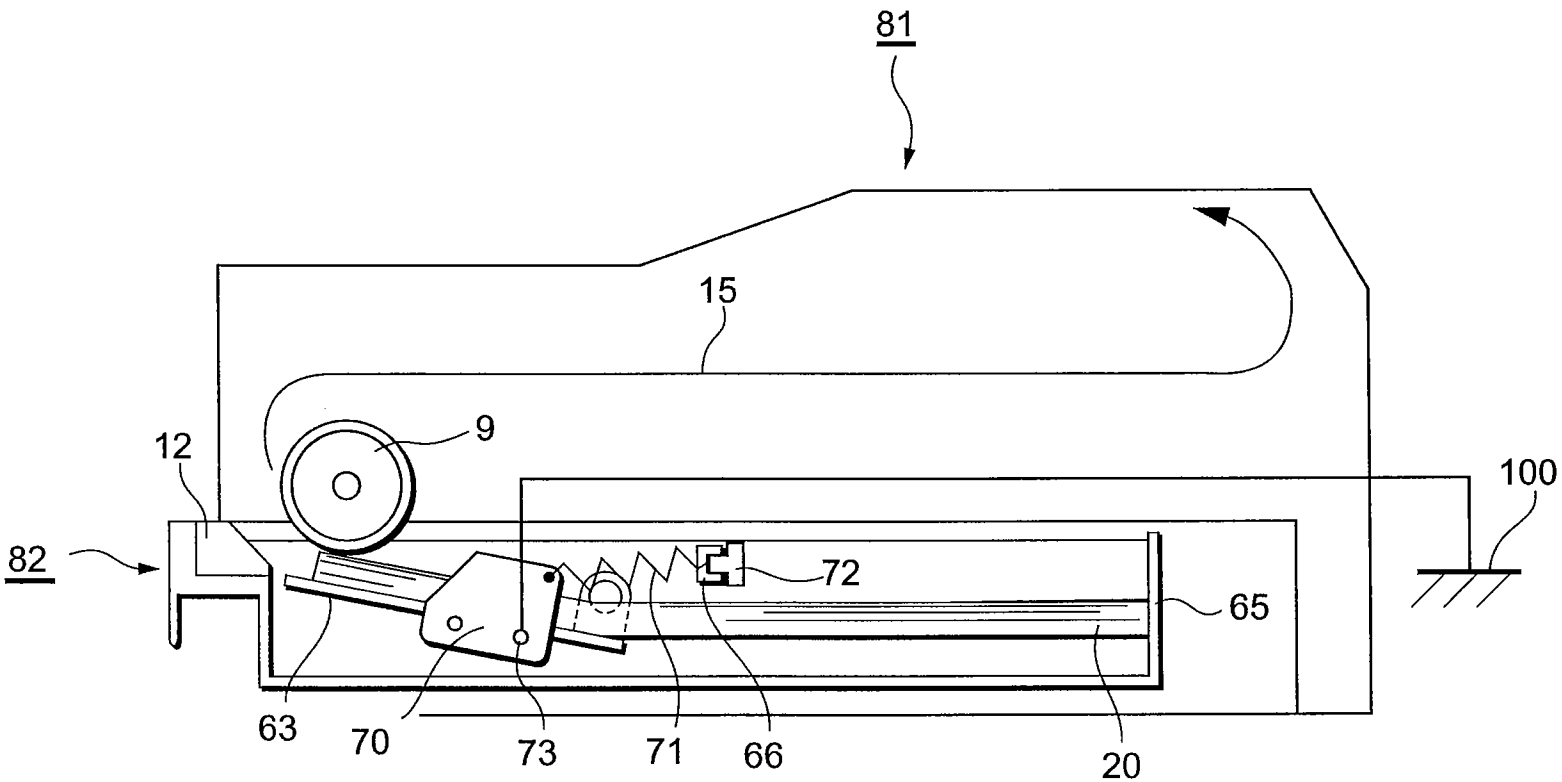
FIG. 24 is an explanatory diagram showing a chief elements of a structure (a second state of combination) of Embodiment 4.

FIG. 24 is an explanatory diagram showing a chief elements of a structure (a second state of combination) of Embodiment 4.

FIG. 24 shows a state that a catching portion 66 formed on both side walls of the media cassette 62 pushes an arm frame 72 of the pulling up section 68 of the image forming apparatus body 81, when the media cassette 82 is still on a way near to a position where the media cassette 82 is attached to the image forming apparatus body 81. As a result, in the pulling up section 68, an arm spring 71 is pulled, so as to begin rotating an arm plate 70 around a fulcrum portion 73 (a second state of combination).

In the second state of combination, the recording media 20 does not contact with a media supplying roller 9 yet.

Figure 25:
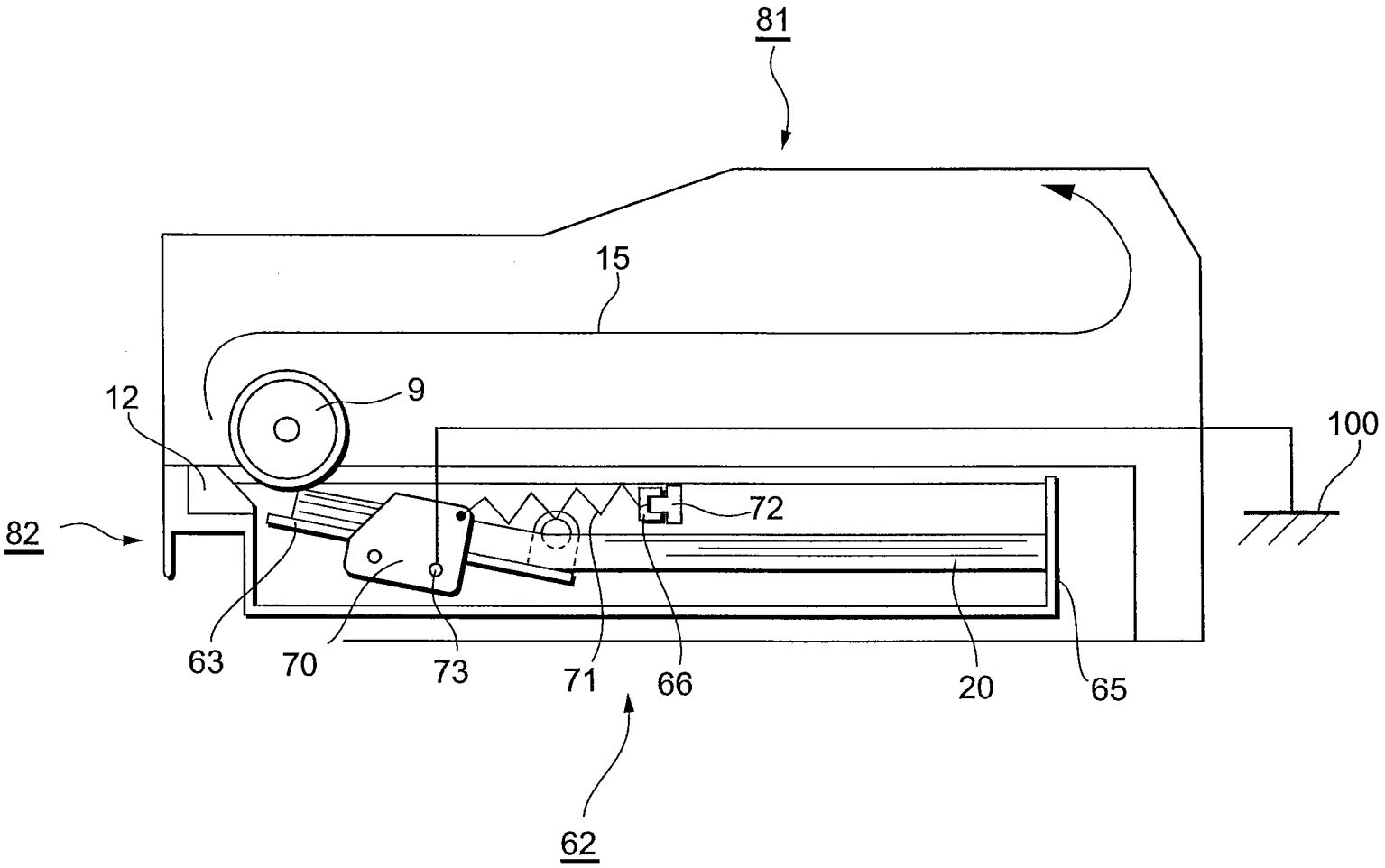
FIG. 25 is an explanatory diagram showing a chief elements of a structure (a state of completed attachment) of Embodiment 4.

FIG. 25 is an explanatory diagram showing a chief elements of a structure (a state of a complete attachment) of Embodiment 4.

FIG. 25 shows a state that the media cassette 82 containing the recording media 20 is completely attached to the image forming apparatus body 81. In this state, in the pulling up section 68, an arm spring 71 is pulled, so as to rotate an arm plate 70 around a fulcrum portion 73. As a result, the recording media 20 piled and loaded on the loading plate 63, is pulled by the pulling up section 68 up to the media supplying roller 9. And, a second ground conducting route comprising the recording media 20, the media supplying roller 9, the image forming apparatus body 81 and a grounding point 100; is formed. Then, a static electricity generated in a printing operation by a friction between the recording media 20 and the media supplying roller 9, between the recording media 20 and the separating rubber 12, or between the recording media 20 themselves; and charged on a recording medium; is discharged through the second ground conducting route including the media supplying roller 9, to a grounding point 100.

As described above, Embodiment 4 obtains an effect that the number of component parts can be further decreased in addition to the same effect as Embodiment 3, because a fulcrum portion 73 of a pulling up section 68 comprises a first ground conducting route in Embodiment 4.

Incidentally, in the above Embodiments, an image forming apparatus body attached with only one media cassette was described. However, the present invention is not limited to this example. That is, the present invention can be applied to an image forming apparatus body attached with plural media cassettes.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An image forming apparatus comprising:

an image forming apparatus body including a cassette attaching section having a media supplying roller that supplies media to the image forming apparatus body;

a media cassette removably installed in the cassette attaching section, the media cassette including:

a loading plate mounted in the media cassette to support media stacked up in the media cassette;

a pushing up member that pushes up the loading plate to the media supplying roller, a supporting section that supports the loading plate, the loading plate configured to rotate when the loading plate is pushed up by the pushing up member, and a plate holding portion that engages the loading plate and holds the pushing up of the pushing up member until the loading plate is installed in a first position, wherein in the first position, the plate holding portion releases its hold on the pushing up member so that the media contacts the media supplying roller as a result of the pushing up member pushing up the loading plate, wherein the loading plate supports the media stacked up in the media cassette in a position lower than and away from the media supplying roller when the plate holding portion engages the loading plate and wherein the loading plate moves a top surface of the media to a position higher than the supporting section and in contact with the media supplying roller when the plate holding portion releases its hold on the pushing up member;

a release portion that engages the plate holding portion, the release portion configured to cause the plate holding portion to release its hold on the pushing up member in the first position;

a first ground conducting route that conducts static electricity charged on the media when the media stacked up in the media cassette is in the position lower than and away from the media supplying roller and before the loading plate is installed in the first position, the first ground conducting route including:

a conducting portion wherein the media cassette and the image forming apparatus body are reconfigured from an electrically disconnected state to an electrically connected state in a position lower than a horizontal position of the supporting section, wherein the conducting portion of the first ground conducting route is located in an upstream side of a cassette installing direction of the media cassette into the cassette attaching section from the supporting section in a the first position;

a second ground conducting route that conducts static electricity charged on the media when the media is conveyed by the media supplying roller, and a guide that makes the media cassette capable of stacking the media up to a position higher than the conducting portion of the first conducting route in a state wherein the plate holding portion engages the loading plate.

2. An image forming apparatus comprising:

an image forming apparatus body including a cassette attaching section having a media supplying roller that supplies media to the image forming apparatus body;

a media cassette removably installed in the cassette attaching section, the media cassette including:

a loading plate mounted in the media cassette to support media stacked up in the media cassette;

a pushing up member configured to push up the loading plate to the media supplying roller, and a plate holding portion that engages the loading plate, the plate holding portion configured to hold the pushing up of the pushing up member until the media cassette is installed in a first position, wherein in the first position, the plate holding portion releases its hold on the pushing up member so that the media contacts the media supplying roller as a result of the pushing up member pushing up the loading plate;

a release portion configured to engage the plate holding portion and to release the plate holding portion in the first position;

a first ground conducting route that conducts static electricity charged on the media when the media stacked up in the media cassette is in the position lower than and away from the media supplying roller and before the loading plate is installed in the first position, the first ground conducting route including:

a conducting portion wherein the media cassette and the image forming apparatus body are reconfigured from an electrically disconnected state to an electrically connected state as the media cassette is inserted into the cassette attaching section; and a second ground conducting route that conducts static electricity charged on the media when the media is conveyed by the media supplying roller in the first position; and a supporting section that supports the loading plate, the loading plate being configured to rotate when the loading plate is pushed up by the pushing up member, wherein the conducting portion of the first ground conducting route is located in an upstream side of a cassette installing direction, defined by an insertion direction of the media cassette into the cassette attaching section, relative to the supporting section in the first position.

3. An image forming apparatus comprising:

an image forming apparatus body including a cassette attaching section having a media supplying roller that supplies media to the image forming apparatus body;

a media cassette removably installed in the cassette attaching section, the media cassette including:

a loading plate mounted in the media cassette to support media stacked up in the media cassette;

a pushing up member configured to push up the loading plate in a direction toward the media supplying roller when the media cassette is installed in the cassette attaching section, and a plate holding portion that is engageable with the loading plate, the plate holding portion configured to hold the pushing up of the pushing up member until the media cassette is installed in a first position in the image forming apparatus body, wherein in the first position, the plate holding portion has a position spaced away from a moving range of a crook portion of the loading plate so that the media on the loading plate is pushed up toward the media supplying roller as a result of the pushing up member pushing up the loading plate;

a release portion configured to contact the plate holding portion and to move the plate holding portion to the position spaced away from the moving range of the crook portion when the media cassette is positioned in the first position;

the loading plate engages the plate holding portion until the media cassette is installed in the cassette attaching section, the media stacked up in the media cassette is in a height position lower than and away from the media supplying roller as the media cassette is urged into the cassette attaching section, when the media cassette is positioned in the first position, the plate holding portion being spaced away from the moving range of the crook portion so that the media in the media cassette rises as a result of the pushing up member pushing up the loading plate, a first ground conducting route conducts static electricity charged on the media before the media is in contact with the media supplying roller as the media cassette is inserted into the cassette attaching section;

a second ground conducting route conducts static electricity charged on the media when the media is in contact with the media supplying roller in the first position; and a supporting section that supports the loading plate, the loading plate being configured to rotate when the loading plate is pushed up by the pushing up member, wherein a conducting portion of the first ground conducting route is located in an upstream side of a cassette installing direction, defined by an insertion direction of the media cassette into the cassette attaching section, relative to the supporting section in the first position.

4. The image forming apparatus according to claim 3, wherein a guide locates the lowest surface of the media stacked up in the media cassette in a position lower than the supporting section and locates the top surface of the media up to a position higher than the conducting portion of the first ground conducting route in a state wherein the plate holding portion engages the loading plate.

5. The image forming apparatus according to claim 3, wherein the first ground conducting route extends in a direction transverse to the cassette installing direction of the media cassette into the media cassette attaching section from the conducting portion.

6. The image forming apparatus of claim 3, wherein the conducting portion of the first ground conducting route is located on the media cassette behind a front of the media with a portion of the conducting portion being located proximate a rear edge of the media.

7. The image forming apparatus of claim 3, wherein the media cassette is in an electrically disconnected state when the supporting section moves from the first position opposite the cassette installing direction when the conducting portion exits the opening of the cassette attaching section.

8. The image forming apparatus of claim 3, wherein the media in the media cassette has a front edge at the front and a rear edge at the rear, the rear edge configured to pass through the opening of the cassette attaching section toward the cassette installing direction as the media cassette moves toward the first position, the media contacts the media supplying roller between the front edge and the rear edge.

* * * * *